US007980277B2

(12) United States Patent
Amano

(10) Patent No.: US 7,980,277 B2
(45) Date of Patent: Jul. 19, 2011

(54) POWDER CHARGING DEVICE AND POWDER CHARGING METHOD

(75) Inventor: Hirosato Amano, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1219 days.

(21) Appl. No.: 10/549,918

(22) PCT Filed: Mar. 15, 2004

(86) PCT No.: PCT/JP2004/003417

§ 371 (c)(1),
(2), (4) Date: Dec. 4, 2006

(87) PCT Pub. No.: WO2004/083038

PCT Pub. Date: Sep. 30, 2004

(65) Prior Publication Data

US 2007/0157990 A1 Jul. 12, 2007

(30) Foreign Application Priority Data

Mar. 20, 2003 (JP) ..... 2003-079006
Mar. 20, 2003 (JP) ..... 2003-079007
Apr. 9, 2003 (JP) ..... 2003-105677

(51) Int. Cl.
*B65B 1/30* (2006.01)

(52) U.S. Cl. ..... 141/83; 141/65; 141/95; 141/286; 141/301

(58) Field of Classification Search ..... 141/65, 141/67, 69, 83, 95, 286–302
See application file for complete search history.

(56) References Cited

U.S. PATENT DOCUMENTS 3,188,144 A 6/1965 Gmür et al.
4,212,331 A 7/1980 Benatar
5,727,607 A * 3/1998 Ichikawa et al. ..... 141/67
(Continued)

FOREIGN PATENT DOCUMENTS

BE 1000561 A6 2/1989
(Continued)

OTHER PUBLICATIONS

U.S. Appl. No. 11/911,598, filed Oct. 15, 2007, Sano, et al.
(Continued)

*Primary Examiner* — Timothy L Maust
(74) *Attorney, Agent, or Firm* — Oblon, Spivak, McClelland, Maier & Neustadt, L.L.P.

(57) ABSTRACT

The invention discloses a powder filling device and method which is capable of making stable powder flow rate, preventing powder from being leaked or dispersed during filling operation, and filling the powder in a short time in a new powder filling system filling the powder from a measuring tank to a powder filling container. The powder filling device comprises a measuring tank having a powder discharge port and a filling amount control unit disposed near the powder discharge port, and an auxiliary container having an opening disposed on the underside of the powder discharge port of the measuring tank which faces downward. The powder filling device is characterized in that a powder externally delivered into the measuring tank is discharged from the powder discharge port into the powder filling container disposed on the underside of the auxiliary container while a filling amount of the powder is controlled by the filling amount control unit, and the powder is temporarily dropped to the auxiliary container, and further dropped to the powder filling container so that the powder filling container is filled up with the powder.

50 Claims, 9 Drawing Sheets

U.S. PATENT DOCUMENTS

| | | | | |
|---|---|---|---|---|
| 6,021,821 | A * | 2/2000 | Wegman | 141/93 |
| 6,056,027 | A | 5/2000 | Patterson | |
| 6,311,745 | B1 | 11/2001 | Welch et al. | |
| 6,854,493 | B2 * | 2/2005 | Ichikawa et al. | 141/301 |
| 6,863,096 | B2 * | 3/2005 | Amano | 141/59 |
| 7,191,807 | B2 * | 3/2007 | DeMaison et al. | 141/83 |

FOREIGN PATENT DOCUMENTS

| | | | |
|---|---|---|---|
| DE | 38 02 259 | A1 | 8/1989 |
| EP | 1 334 906 | A2 | 8/2003 |
| JP | 46-22680 | | 6/1971 |
| JP | 54-5578 | | 1/1979 |
| JP | 55-49524 | | 11/1980 |
| JP | 126301/1982 | | 8/1982 |
| JP | 59-26521 | | 6/1984 |
| JP | 3-098802 | | 4/1991 |
| JP | 4-087901 | | 3/1992 |
| JP | 5-223627 | | 8/1993 |
| JP | 6-263101 | | 9/1994 |
| JP | 08-198203 | | 8/1996 |
| JP | 9-193902 | | 7/1997 |
| JP | 11-79101 | | 3/1999 |
| JP | 2000-1224 | | 1/2000 |
| JP | 2002-347701 | | 12/2002 |

OTHER PUBLICATIONS

U.S. Appl. No. 12/018,611, filed Jan. 23, 2008, Sano.
U.S. Appl. No. 11/683,253, filed Mar. 7, 2007, Itoh, et al.
U.S. Appl. No. 11/736,296, filed Apr. 17, 2007, Sano.

* cited by examiner

POWDER CHARGING DEVICE AND POWDER CHARGING METHOD

TECHNICAL FIELD

This invention relates to a powder filling device and a powder filling method for filling up a large-sized container or a small-sized powder container with a given amount of a powder for electrostatic latent image development whose average particle diameter is on the order of microns. More particularly, this invention relates to the powder filling method and device which fill up a small powder container with the toner for electrostatic latent image development of a given amount quickly and safely, not giving stress to the toner for electrostatic latent image development, and without making the working environment and the worker dirty. And when the subdivision for the fractionation storage from the large-sized container is temporarily stored in the small powder container or delivered in the manufacturing process of powder and also in the case of filling on demand to the small toner container at the location of an end user, the powder filling method and device of this invention may be used.

BACKGROUND ART

Conventionally, the fundamental concept of a filling method of powder, such as toner powder for electro photography, is that the powder from a large-sized container is dropped by its gravity into a small toner container arranged right under the large-sized container, and the small toner container is filled up with the powder. In this method, there are a rotary valve type, a screw feeder type, and an auger machine type. Especially the auger machine type method is known as the method which fills up the container of a fixed volume with the powder efficiently, and it is put in practical use. For example, see Japanese Laid-Open Patent Application No. 04-087901 and Japanese Laid-Open Patent Application No. 06-263101.

Immediately after the toner is filled into the small toner container by such powder filling method, a lot of air is contained between the powder particles. In order to store a lot of powder in a high-density state in the container for a short time, a suction pipe is inserted into the container so that the leading edge of the suction pipe is buried in the powder within the container, so that deaerating is performed with the suction pipe. For example, see Japanese Laid-Open Patent Application No. 09-193902.

Usually, in the auger machine type method, the auger machine in the shape of a screw provided in the inside near the outlet of a conic hopper is rotated, and the toner powder in the hopper is discharged downwardly from the outlet. And, after the discharging, the toner powder is stored in two or more containers arranged and conveyed on the transportation belt one by one.

In recent years, as for the image formation by the electrophotographic printing method, there is the increasing demand for improvement in the speed, highly-minute image, high image quality etc. With this demand, there are also various studies for developing toner powder, in order for micrifying the grain size of toner powder, sticking a metal oxide particle (called an external additive) to the surface of toner powder to increase the flowability, or securing low-temperature fixability using a binder resin with a low fusing point. Such studies are put into the practical use.

However, the toner powder will be pressurized by rotation of the auger machine according to the above-mentioned auger machine type method, and there is a problem in that the external additive may be separated or isolated from the surface of toner powder, and may be further buried into the toner powder. And the problem arises in that the original function of the external additive to increase the flowability is reduced or eliminated.

In addition, in a case of a low-temperature fixing toner powder with which a binder resin with a low melting point is used, the toner powder adheres by the pressurization by rotation of the auger machine, and it becomes easy to create the cohesion. It sometimes solidifies so that the cohesion does not return to the toner powder. As a result, the toner powder will be got blocked with the exit of the hopper, the discharging will stop, and the problem of interfering with the filling work of the toner also arises.

Originally, the more easily the toner powder falls to the container from the hopper, the more the grain size becomes smaller. And the Brownian motion is easily performed in a gas regardless of the kind of the source material and the toner powder is easily set in an atomizing state. As a result, the necessity of discharging a lot of gas existing between the powder particles will arise, and it will be difficult to form the high-density filling state of the toner powder in the container. Thus, it is desired that the above-mentioned problem will be solved with respect to such difficulty.

Moreover, as mentioned above, the auger machine serves as a large-scale device which requires at least the hopper and the filling machine including the belt on which two or more small toner containers are carried and conveyed, and the container concerned must be arranged at the location just under the filling machine. There is the problem in that the arrangement of the auger machine must be a fixed one and has some restrictions.

Furthermore, the toner powder for electrostatic latent image development is of a very small diameter, and the specific gravity is smaller than other powders, such as that of a ceramic material, but the flowability is poor and the coherence is high.

Recently, in order to reply to the demands for higher resolution of the developed image, the use of the toner powder for electrostatic latent image development of a smaller diameter is progressing increasingly. In addition, it is in the tendency that a resin with a low-temperature fusibility is adopted increasingly in order to reply to the demand of energy saving and instant high-speed fixing. The coherence, and the adhesion to other object surface and the filming nature are the other problems, and improving these features or avoiding the fluidity fall and the condensation is desired.

In many cases, for that purpose, it is used in the form where the toner particle surface is contained with the ultrafine particles, such as a flow improver and a condensation inhibitor, and contained with the charge modifier ultrafine particles for improving the charging characteristics. The agitation and the transfer by the auger machine or the screw conveyor which give superfluous stress to the toner are not desirable from a viewpoint of preventing the separation or isolation of the ultrafine particles with which the toner surface is supported, and ensuring the charging characteristics, the flowability, and the condensation-proof characteristics.

Especially, in the case of a color toner, the toner has a small grain size in order to acquire high resolution, and the components, such as a flow improver, an electrification modifier, a plasticizer, a condensation inhibitor, and a fusion inhibitor, are supported on the toner surface. The grains become entangled, and the flowability is poor. Moreover, when a strong external force is added, there is a danger of spoiling the characteristics of the toner, and the conventional mechanical treatment devices, such as the rotary valve type or the auger machine type, are not preferred.

Moreover, when air is mixed with the toner for the pneumatic treatment of the toner, the toner clouds (the toner particles in the form of cloud which is formed by mixing the toner with a gas) are created due to the floating of the superfine toner particles, and the volume which should be dealt with is increased.

In order to promptly separate the gas from the toner cloud and to make handling easy, it is difficult to attain the prompt separation only by consideration of the structure, the shape or the position of the separation piping. Therefore, it is difficult to control the amount of compression of the toner according to the separation of the gas for the transfer using the separation piping.

When a very fine toner is dealt with, if there is a too large amount of the supply air, a fluid phase will be expanded quickly and will shift to a dust phase easily. A long time may be taken to collect the toner from the once generated dust phase, or the circumference may be polluted with dust.

For example, once the toner clouds form, the standing of several hours or several tens of hours will be required only for making the toner deposit on the bottom by a natural fall. The operation for making the deposited toner fluidize and making it move to the small container for the subdivision, while the loose supply air is controlled, is not easy in order to control generation of a large amount of the toner clouds.

If the toner powder from a large-sized container is separated for many subdivision containers, the toner which is mixed to homogeneity initially may become the non-uniform components gradually under the influence of the air supplied into the container, and the necessity to take the countermeasure is proposed.

According to this proposal, the small containers are not filled with a toner powder directly from the large-sized container by the agitation and falling as in the auger machine type, but the toner from the large-sized container is delivered to a measuring tank temporarily, and the small toner container is filled up with the toner by using the measuring tank. This proposed method is to use a filling amount control unit for discharging only a given amount of the toner, among the toner delivered to the measuring tank, into the small toner container which is provided in the discharge opening of the measuring tank for the toner discharge.

Next, the new filling method according this proposal will be explained using the cross-sectional view of FIG. 1. FIG. 1 shows an example of the toner filling device used for the new filling method.

In the toner filling device of FIG. 1, a small toner container (40) is filled up with the very fine toner in a large-sized container (10) by using a measuring tank (30). The large-sized container (10) and the measuring tank (30) communicate with each other through the connecting tube (20) between the toner outlet (11) of the large-sized container (10) and the toner entrance of the measuring tank (30).

The measuring tank (30) has a filling amount control unit (32) at the discharge opening (31) where the toner is discharged into the small toner container, and the filling amount control unit (32) is provided for opening and closing the discharge opening (31) to fill up the small toner container (40) only with a given amount of the toner.

The large-sized container (10) has the inside wall portion (12) which is inclined in such a manner that it does not bar slipping down of the toner stored inside. And, by this inclined inside wall portion (12) inside, discharging of the very fine toner to the toner outlet (11) is carried out smoothly.

In the toner filling device of this example, the inclined inside wall portion (12) forms a part of the structural portion (13) of the lower portion of the large-sized container (10) in the shape of a hopper.

The large-sized container (10) and the measuring tank (30) are also connected with a top communicating pipe (50) formed in the upper part of the connecting tube (20), and this top communicating pipe (50) is inclined upward toward the large-sized container (10) from the measuring tank (30).

The top communicating pipe (50) serves to keep the pressure in the measuring tank (30) equal to the pressure in the large-sized container (10). And when a too large quantity of the gas is discharged from the 3rd toner fluidization unit (33) and too large toner clouds are formed in the measuring tank (30), the excessive amount of the gas can be extracted into the large-sized container (10) by using the top communicating pipe (50), and with the upward inclination of the top communicating pipe the toner grains accompanied therewith can be returned to the measuring tank (30).

The toner powder discharged from the toner outlet (11) of the large-sized container (10) bottom is delivered to the measuring tank (30) through the connecting tube (20).

In the measuring tank (30) in this example, the filling amount control unit (32) is provided in the discharge opening (31) for exact and smooth filling of the toner in only the given amount.

The filling amount control unit (32) in the powder filling device of this example comprises an elastic body ring (32*a*) having a discharge opening (31), and a discharge control unit (32*b*) which controls the discharge of the toner from the discharge opening (31). The discharge control unit (32*b*) comprises a discharge control member (32*d*) disposed in the discharge control lever (32*c*) which is moved up and down inside the measuring tank (30). The discharge control member (32*d*) is a member in the conical shape which intercalates—breaks away with a discharge opening (31), and which opens and closes the discharge opening (31) through the insertion into the discharge opening (31) and the separation from the discharge opening (31). The degree of the insertion into the discharge opening (31) is adjusted by the insertion degree and the fitting degree of the elastic body ring (32*a*) of the discharge control member (32*d*) of the conical shape which varies depending on the degree of the up/down movement of the discharge control lever (32*c*) within the measuring tank (30).

When the discharge control member (32*d*) is moved up so that the edge of the conical part of the discharge control member (32*d*) with the small radius is completely separated from the discharge opening (31), it is in the fully open state (the toner is freely discharged to fill the small toner container). When the discharge control member (32*d*) is moved down so that the based end of the conical part of the discharge control member (32*d*) with the large radius is completely fitted into the discharge opening (31), it is in the fully closed state (the discharging of the toner is stopped).

When the discharge control member (32*d*) is in the intermediate state (i.e., when it is not separated from the discharge opening (31) completely and is not descended completely, and it is not inserted in such a manner that a gap is held between the middle radius part of the discharge control member (32*d*) and the discharge opening (31)), it is in a half-opening state (partial discharging of the toner) according to the degree of the insertion.

As mentioned above, the new powder filling method proposed by the present inventor is characterized in that the powder in the large-sized container is delivered to the measuring tank temporarily, the powder filling container is filled up with the powder from the measuring tank directly, and the filling amount control unit for discharging the powder of only the given amount to the discharge opening of the measuring tank is provided.

In carrying out the new powder filling method concretely, the present inventor confirmed that the following new problems arise.

1. Filling of the powder and the air displacement in the container cannot be performed, and the powder may overflow.
2. the ratio of the amount of the powder and the quantity of the gas varies, and the flow rate may become unstable.
3. Because of the necessity for the gas discharge in the powder filling container, the powder discharge port of the measuring tank and the opening of the powder filling container cannot be sealed, and the powder may leak from a gap and disperse so that the powder filling device neighborhood is polluted with such powder.

Accordingly, an object of the present invention is to provide a powder filling device and method which is capable of making stable powder flow rate, preventing the powder from being leaked or dispersed during the filling operation, and filling the powder in a short time in carrying out the new powder filling method.

DISCLOSURE OF THE INVENTION

As an improvement of the filling amount control unit in the new powder filling method described above, a filling amount control unit in the powder filling device shown in FIG. 2 is conceivable. This filling amount control unit in the powder filling device of FIG. 2 comprises a filter material which passes a gas but does not pass powder particles and is disposed near the powder discharge port of the measuring tank. Using a gas suction unit communicating with the filling amount control unit, the powder is drawn to the filter material and the amount of discharge of the powder to the powder filling container is controlled by the degree of suction of the powder by the gas suction unit.

According to the special filling amount control unit of the above-mentioned method, mechanical stress is not given to the powder or the toner for electrophotographic printing method, and it is effective in that the reduction of the characteristics of the powder is not caused. However, the above-mentioned method is not adequate for solving all the above-mentioned problems.

In order to achieve the above-mentioned object, the present invention provides a powder filling device comprising: a measuring tank having a powder discharge port and a filling amount control unit disposed near the powder discharge port; and an auxiliary container having an opening disposed on an underside of the powder discharge port of the measuring tank which faces downward, wherein a powder externally delivered into the measuring tank is discharged from the powder discharge port into a powder filling container disposed on an underside of the auxiliary container while a filling amount of the powder is controlled by the filling amount control unit, and the powder is temporarily dropped to the auxiliary container, and further dropped to the powder filling container so that the powder filling container is filled up with the powder.

Moreover, in order to achieve the above-mentioned object, the present invention provides a powder filling method which fills up a powder filling container with a powder by using a powder filling device comprising a measuring tank having a powder discharge port and a filling amount control unit disposed near the powder discharge port, and an auxiliary container having an opening disposed on an underside of the powder discharge port of the measuring tank which faces downward, the powder filling method comprising: disposing the powder filling container on an underside of the auxiliary container; discharging a powder, which is externally delivered into the measuring tank, from the powder discharge port into the powder filling container while a filling amount of the powder is controlled by the filling amount control unit; temporarily dropping the powder in the auxiliary container so that a gas existing between particles of the powder within the auxiliary container is freely discharged; and further dropping the powder in the powder filling container so that the powder filling container is filled up with the powder.

According to the present invention, the powder filling device which comprises: the measuring tank having the powder discharge port and the filling amount control unit disposed near the powder discharge port; and the auxiliary container having the opening disposed on the underside of the powder discharge port of the measuring tank which faces downward is used. The powder externally delivered to the measuring tank is discharged from the powder discharge port into the powder filling container disposed on the underside of the auxiliary container while the filling amount of the powder is controlled by the filling amount control unit, and the powder is temporarily dropped to the auxiliary container, and further dropped to the powder filling container.

Therefore, the flow rate of the powder is made stable, and it is possible to fill up the powder filling container with the powder for a short time while preventing the powder from being leaked or dispersed during the filling work. By using the auxiliary container having the opening part, the gas existing between the powder particles once collected can escape from the opening part. Even when the powder is dropped to the powder filling container, the amount of the existing gas is made small, and the existing gas can easily escape from the opening part. As a result, the state in which the powder filling container is full of the gas is avoided.

Moreover, in order to achieve the above-mentioned object, the present invention provides a powder filling device comprising: a measuring tank having a powder discharge port and a filling amount control unit disposed near the powder discharge port; and an auxiliary container having a gas permutation unit disposed on an underside of the powder discharge port of the measuring tank which faces downward, wherein a powder externally delivered into the measuring tank is discharged from the powder discharge port into a powder filling container disposed on an underside of the auxiliary container while a filling amount of the powder is controlled by the filling amount control unit, and the powder is temporarily dropped to the auxiliary container, and further dropped to the powder filling container so that the powder filling container is filled up with the powder.

According to the present invention, the powder filling device which comprises: the measuring tank having the powder discharge port and the filling amount control unit disposed near the powder discharge port; and the auxiliary container having the gas permutation unit disposed on the underside of the powder discharge port of the measuring tank which faces downward is used. The powder externally delivered to the measuring tank is discharged from the powder discharge port into the powder filling container disposed on the underside of the auxiliary container while the filling amount of the powder is controlled by the filling amount control unit, and the powder is temporarily dropped to the auxiliary container, and further dropped to the powder filling container.

Therefore, the flow rate of the powder is made stable, and it is possible to fill up the powder filling container with the powder for a short time while preventing the powder from being leaked or dispersed during the filling work. By using the gas permutation unit provided in the auxiliary container, the gas existing between the powder particles once collected can be returned to the auxiliary container. Even when the powder is dropped to the powder filling container, the amount of the existing gas is made small, and the existing gas can be easily returned to the auxiliary container. As a result, the state in which the powder filling container is full of the gas is avoided. filling method make it possible to fill up the container with the powder of a given amount in a high-density state efficiently and precisely.

Other objects, features and advantages of the present invention will be apparent from the following detailed description when reading in conjunction with the accompanying drawings.

BEST MODE FOR CARRYING OUT THE INVENTION

Figure 1:
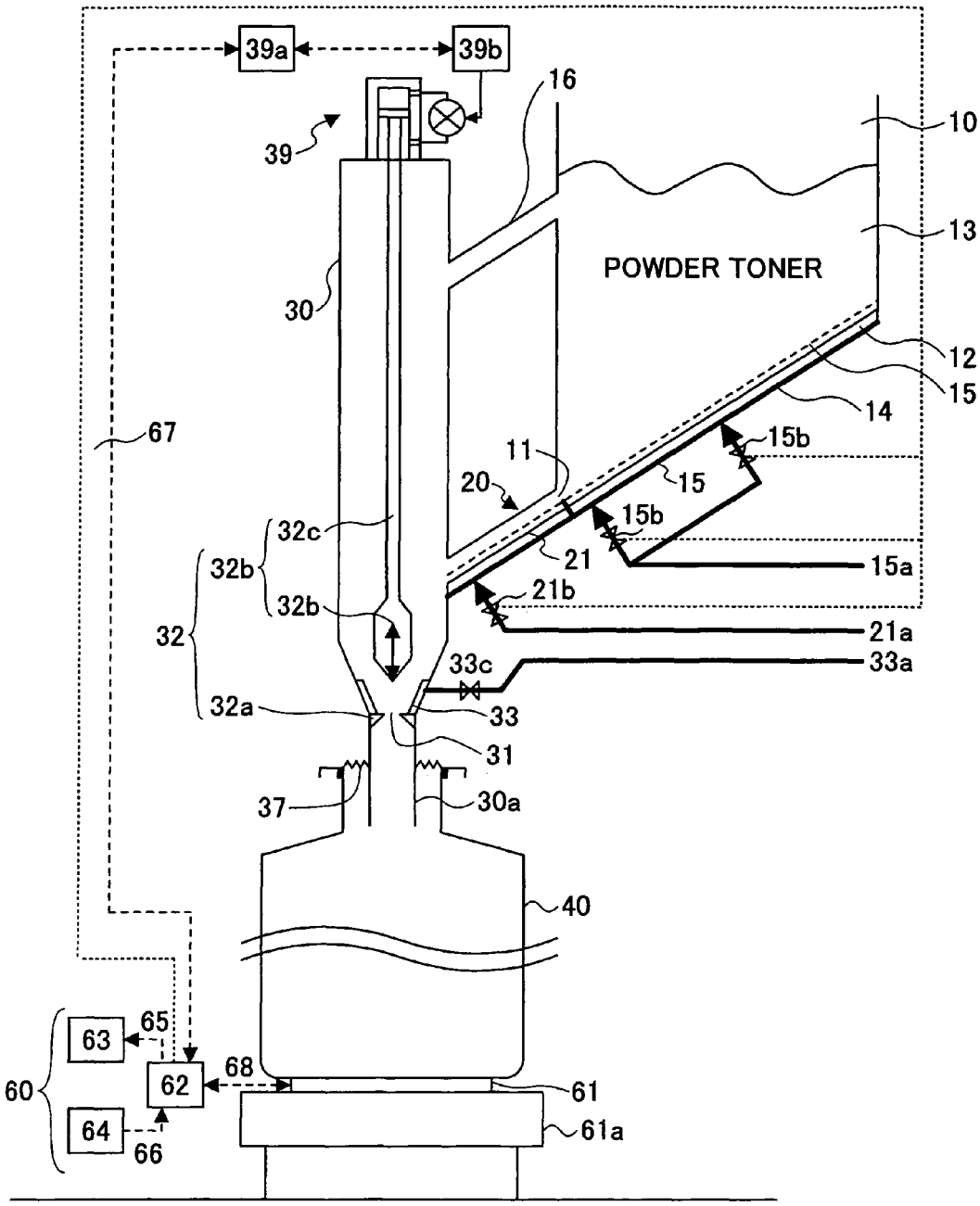
FIG. 1 is a cross-sectional view showing an example of a powder filling device.

A description will be given of the preferred embodiments of the present invention with reference to the accompanying drawings.

First, the first preferred embodiment of the present invention will be explained.

In the powder filling device of this embodiment, the measuring tank has the powder discharge port and the filling amount control unit disposed near the powder discharge port. The auxiliary container has the opening disposed on the underside of the powder discharge port of the measuring tank which faces downward. The powder externally delivered to the measuring tank is discharged from the powder discharge port into the powder filling container disposed on the underside of the auxiliary container while the filling amount of the powder is controlled by the filling amount control unit, and the powder is temporarily dropped to the auxiliary container, and further dropped to the powder filling container.

Therefore, the flow rate of the powder is made stable, and it is possible to fill up the powder filling container with the powder for a short time while preventing the powder from being leaked or dispersed during the filling work. By using the auxiliary container having the opening part, the gas existing between the powder particles once collected can escape from the opening part. Even when the powder is dropped to the powder filling container, the amount of the existing gas is made small, and the existing gas can easily escape from the opening part. As a result, the state in which the powder filling container is full of the gas is avoided.

The above-mentioned powder filling device may be configured so that the auxiliary container is of a conical funnel-like type, and is arranged so that a tubular body part of the auxiliary container having an outlet is inserted into an opening of the powder filling container.

The conical funnel-like auxiliary container has the opening part of the conical bottom larger than the powder discharge port of the measuring tank, it is easy to receive the discharged powder, and it is possible to prevent the powder from scattering to the device circumference. Since it is easy to remove the gas existing between the powder particles and the ratio of the gas and the powder does not vary, the flow rate of the powder is made stable. This is effective in shortening the powder filling time. It does not cause toner leakage or toner discharge stopping but continuous toner filling is attained.

When compared with the case where no auxiliary container is used, the filling speed according to this embodiment can be shortened by 15 to 30%.

The above-mentioned powder filling device may be configured so that an angle of a conical top part of the auxiliary container is in a range of 50 to 70 degrees. It is desirable to use the auxiliary container whose diameter of the conical bottom is in a range of 130 to 180 mm. By this composition, the dropping of the powder from the auxiliary container to the powder filling container is performed smoothly.

Although there is no restriction in the kind of the material of the auxiliary container, the auxiliary container made of a resin is preferred with respect to the workability. For example, polyester, polycarbonate or acrylic resin may be used as the material of the auxiliary container. Such material is translucent, and the discharge state of the internal powder can be confirmed.

Moreover, a nozzle or packing made of a cushion-like material, such as a sponge, may be attached to the edge of the tubular body part of the funnel-like auxiliary container so that the outlet is formed. The auxiliary container and the powder filling container may be disposed such that the opening of the powder filling container hits the nozzle, and an impact of the arrangement can be eased.

The above-mentioned powder filling device may be configured to further comprise a rising/falling unit provided for moving up and down the auxiliary container.

The above-mentioned powder filling device may be configured so that the filling amount control unit is provided with at least three filling amount control functions of free powder discharging, powder discharge stopping, and partial powder discharging.

The above-mentioned powder filling device may be configured so that the measuring tank is formed with a cylinder body which extends from a position where the filling amount control unit is disposed to a position of the powder discharge port.

The above-mentioned powder filling device may be configured so that the filling amount control unit comprises an elastic body ring fixed to the powder discharge port of the measuring tank, and a discharge control unit which controls discharging of the powder from the powder discharge port, wherein the discharge control unit comprises a discharge amount control member which is mounted on a discharge control lever which is moved up and down within the measuring tank, and wherein the discharge amount control member comprises a conical-shape member which opens and closes the powder discharge port by separation of the conical-shape member from the powder discharge port and insertion of the conical-shape member to the powder discharge port.

The above-mentioned powder filling device may be configured so that a degree of opening/closing of the powder discharge port is adjusted by a degree of insertion of the conical-shape member to an opening of the elastic body ring which depends on a degree of an up/down movement of the discharge control lever within the measuring tank.

The above-mentioned powder filling device may be configured so that the filling amount control unit is made of a filter material which passes a gas and does not pass the powder, and the powder is drawn to the filter material by using a gas suction unit communicating with the filling amount control unit, so that the filling amount of the powder is controlled according to a degree of suction of the powder by the gas suction unit.

The above-mentioned powder filling device may be configured so that the filling amount control unit is provided so that the filter material is fixed to close a through hole formed in a tubular body part of the auxiliary container, and a wall which does not have a gas leakage is provided around an outside of the filter material so that a space part is formed.

The above-mentioned powder filling device may be configured the filter material is formed in a twill weave.

The above-mentioned powder filling device may be configured so that a powder fluidization hopper which is connected with the measuring tank is provided, and, after the powder in the powder fluidization hopper is delivered to the measuring tank temporarily, the powder in the measuring tank is delivered to the powder filling container.

The above-mentioned powder filling device may be configured so that a powder outlet of the powder fluidization hopper and a powder inlet of the measuring tank communicate with each other through a connecting tube.

The above-mentioned powder filling device may be configured so that the powder fluidization hopper comprises an inclined inside wall portion, and the powder inside the powder fluidization hopper is sent to the powder outlet by the inclined inside wall portion.

The above-mentioned powder filling device may be configured so that the powder fluidization hopper comprises a powder fluidization unit, and the powder in the powder fluidization hopper is fluidized with a gas sent from the powder fluidization unit, and the fluidized powder is sent to the measuring tank.

The above-mentioned powder filling device may be configured so that the powder fluidization unit is provided with a gas introducing pipe attached thereto, and the gas introducing pipe introduces a pressurized gas to a porous body which has a number of fine holes for spouting a gas, and the fine holes communicate with each other inside the porous body.

The above-mentioned powder filling device may be configured so that a plurality of powder fluidization units are provided, and each powder fluidization unit is provided with a gas introducing pipe attached thereto.

The above-mentioned powder filling device may be configured so that the powder fluidization unit is disposed at the inclined inside wall portion.

The above-mentioned powder filling device may be configured so that the connecting tube has a downward inclination such that the powder fluidized with the gas sent from the gas introducing pipe is delivered from the powder fluidization hipper to the measuring tank through the connecting tube.

The above-mentioned powder filling device may be configured so that at least one of the powder fluidization hopper and the measuring tank is provided with a pressure control unit which controls an internal pressure of the at least one of the powder fluidization hopper and the measuring tank.

The above-mentioned powder filling device may be configured so that a filling powder weight managing unit is provided for managing the filling amount of the powder to the powder filling container.

The above-mentioned powder filling device may be configured so that the filling powder weight managing unit comprises a computation processing unit which computes a filled-up powder weight based on an empty weight of the powder filling container on a load cell and a gross weight of the powder filling container which is filled up with the powder.

The above-mentioned powder filling device may be configured so that a powder feed hopper which supplies the powder to the powder fluidization hopper is provided, and a leading edge of a cylindrical part of the powder feed hopper where the powder is supplied is arranged so that the leading edge is buried in a surface portion of a powder layer of the powder fluidization hopper.

Next, the first preferred embodiment of the invention will be described in detail using the accompanying drawings.

Figure 4:
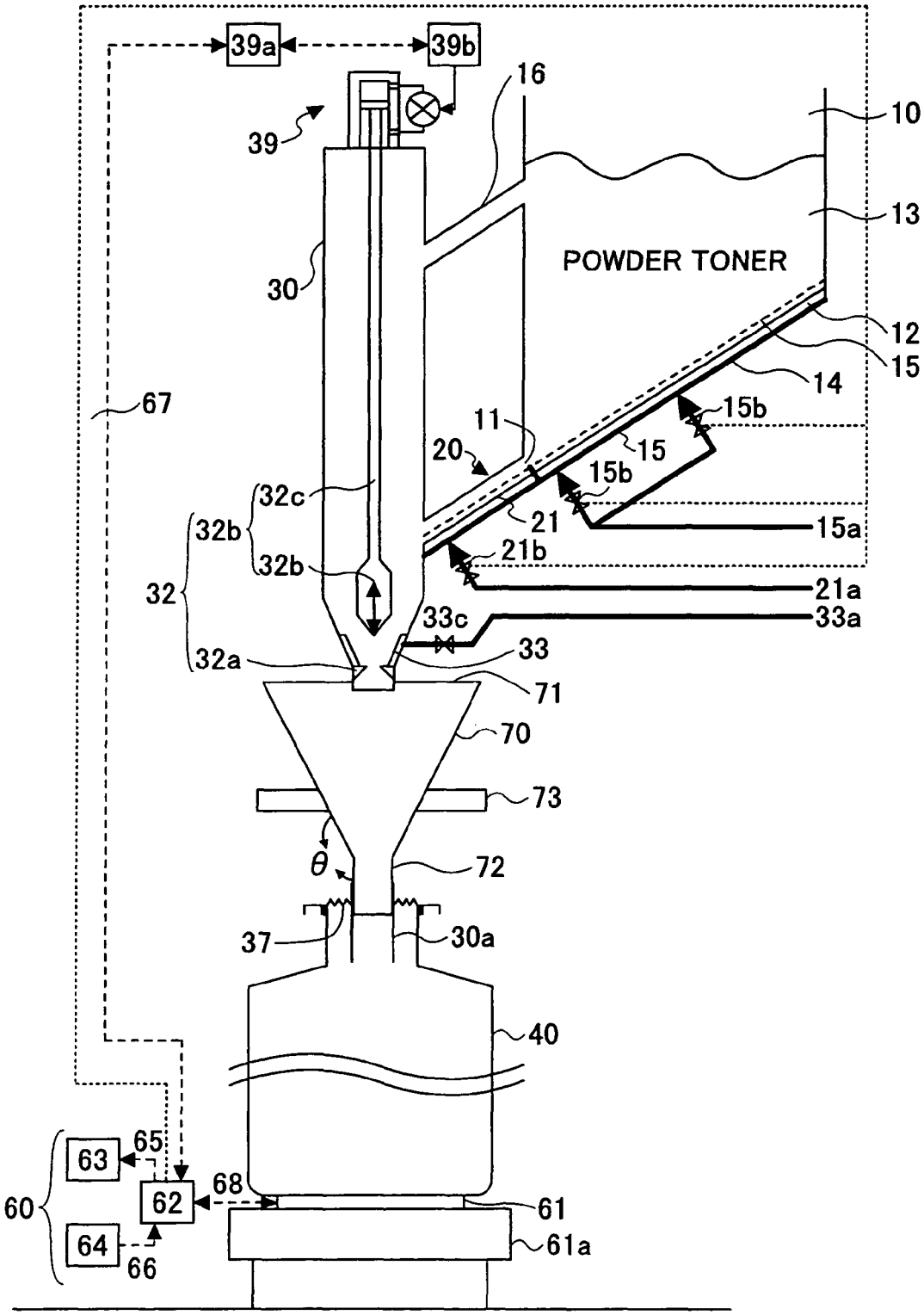
FIG. 4 is a cross-sectional view showing an embodiment of the powder filling device of the present invention.

FIG. 4 shows the embodiment of the powder filling device of this invention in which an auxiliary container is installed in the powder filling device shown in FIG. 1.

In the powder filling device of FIG. 4, after the measuring tank (30) transfer is carried out, the powder in the powder fluidization hopper (10) is once discharged to the auxiliary container (70), and then the powder filling container (40) is filled up with the powder.

The powder fluidization hopper (10) and the measuring tank (30) communicate with each other through the connecting tube (20) between the powder outlet (11) of the powder fluidization hopper (10) and the powder inlet of the measuring tank (30). In the measuring tank (30), the powder discharge port (31) and the filling amount control unit (32) are provided. The size of the powder discharge port (31) is controlled by this filling amount control unit, and only a given amount of the powder is discharged into the auxiliary container (70), and the powder filling container (40) is filled up with such powder.

In FIG. 4, a conical funnel-like auxiliary container is used as the auxiliary container (70), and the conical bottom (71) of this auxiliary container (70) is installed just under the powder discharge port (31) of this measuring tank (30), so that the auxiliary container (70) receives the powder discharged. The tubular body part (72) which has an outlet of the auxiliary container (70) is fitted into the opening of the powder filling container (40), and the auxiliary container and the powder filling container are fixed.

In order to exchange the powder filling container (40) after being filled up with the powder of the given amount with another powder filling container, the auxiliary container (70) is moved up or down by the rising/falling unit (73).

As described above, the auxiliary container (70) is installed in order to perform deaeration of the gas existing between the powder particles falling from the measuring tank and once accumulated in the auxiliary container, or existing in the powder filling container, from the opening part of the conical bottom (71). Alternatively, a deaeration pipe may be inserted into the powder in the auxiliary container, so that deaeration of the gas can be performed at an earlier stage.

The powder fluidization hopper (10) has the inside wall portion (12) which is inclined in such a degree that does not bar slipping down of the powder stored inside, and the discharging of the powder to the outlet (11) of the powder stored inside is carried out smoothly by the inclined inside wall portion (12). In the powder filling device of this embodiment, the inclined inside wall portion (12) forms a part of the hopper-shaped structural portion (13) at the lower part of the powder fluidization hopper (10).

Also the powder fluidization hopper (10) and the measuring tank (30) may be connected by the top connecting tube (16) provided in the upper part of the connecting tube (20). This top connecting tube (16) has a downward inclination which extends to the measuring tank (30) from the powder fluidization hopper (10).

Some reasons of the part communicating pipe (16) having had a role which keeps the pressure in a measuring tank (30) equal to the pressure in a powder fluidization hopper (10), and also there having been too much quantity of the jet gas from the 1st powder fluidization unit (15).

When excessively large toner clouds are formed into a measuring tank (30), the powder grains to accompany can be returned to a measuring tank (30) by being able to extract a superfluous gas in a powder fluidization hopper (10), and inclining downward with this top communicating pipe (50).

The powder discharged from the powder outlet (11) of the powder fluidization hopper (10) bottom is sent to the measuring tank (30) through the connecting tube (20).

At the bottom part of the connecting tube (20), the fluidization unit (not shown) which covers the whole surface in the length direction mostly, and discharges an introductory gas, and includes an air slide block of a porosity plate can be provided. The gas sent from this fluidization unit fluidizes further the powder moved to the measuring tank (30) from the connecting tube (20), and makes the discharging of the powder to the measuring tank speedy.

The connecting tube (20) has a downward inclination extending to the measuring tank (30), and slipping of the fluidized toner down to the measuring tank (30) is assisted by the inclination of the connecting tube.

Concerning the powder fluidization hopper (10), the conditions of the large-sized container disclosed in Japanese Patent Application No. 2002-20980 is applicable.

Next, the measuring tank will be explained.

The material of the measuring tank is not restrictive, and it may be metal, such as stainless steel, titanium, and aluminium, or a product made from a plastic. The measuring tank has a reduced-diameter portion or comprises a tubular structure object, extending from the position where the filling amount control unit is installed to the position of the powder discharge port. A measuring tank of a cylinder type may be used preferably.

It is preferred that the diameter of the thick portion of the measuring tank is in the range of 50 to 200 mm. It is preferred that the diameter of the thin portion of the measuring tank (30) in which the powder discharge port is provided is in the range of 5 to 15 mm. The bottom of the cylindrical body of the thick portion is of the closed structure which is integrally molded with the wall part of the measuring tank using the same material.

The filling amount control unit of FIG. 1 is used as the filling amount control unit (32) in the powder filling device shown in FIG. 4.

Namely, the filling amount control unit (32) comprises the elastic body ring (32*a*) which has the discharge opening (31), and the discharge control unit (32*b*) which controls the discharging of the toner from the powder discharge port (31). The discharge control unit (32*b*) comprises the discharge control member (32*d*) mounted on the discharge control lever (32*c*) which is moved up and down inside the measuring tank (30). The discharge control member (32*d*) is a conical-shape member which opens and closes the powder discharge port (31) by separation from and insertion to the powder discharge port (31). The degree of opening/closing of the powder discharge port (31) is adjusted by the degree of insertion and the degree of fitting of the elastic body ring (32*a*) of the conical-shape discharge control member (32*d*) to the powder discharge port (31) which vary depending on the degree of the up/down movement of the discharge control lever (32*c*) within the measuring tank (30).

The fundamental function of the filling amount control unit (32) in the filling device shown in FIG. 4 is to regulate the filling amount of powder according to the degree of opening/closing of the powder discharge port (31).

Figure 2:
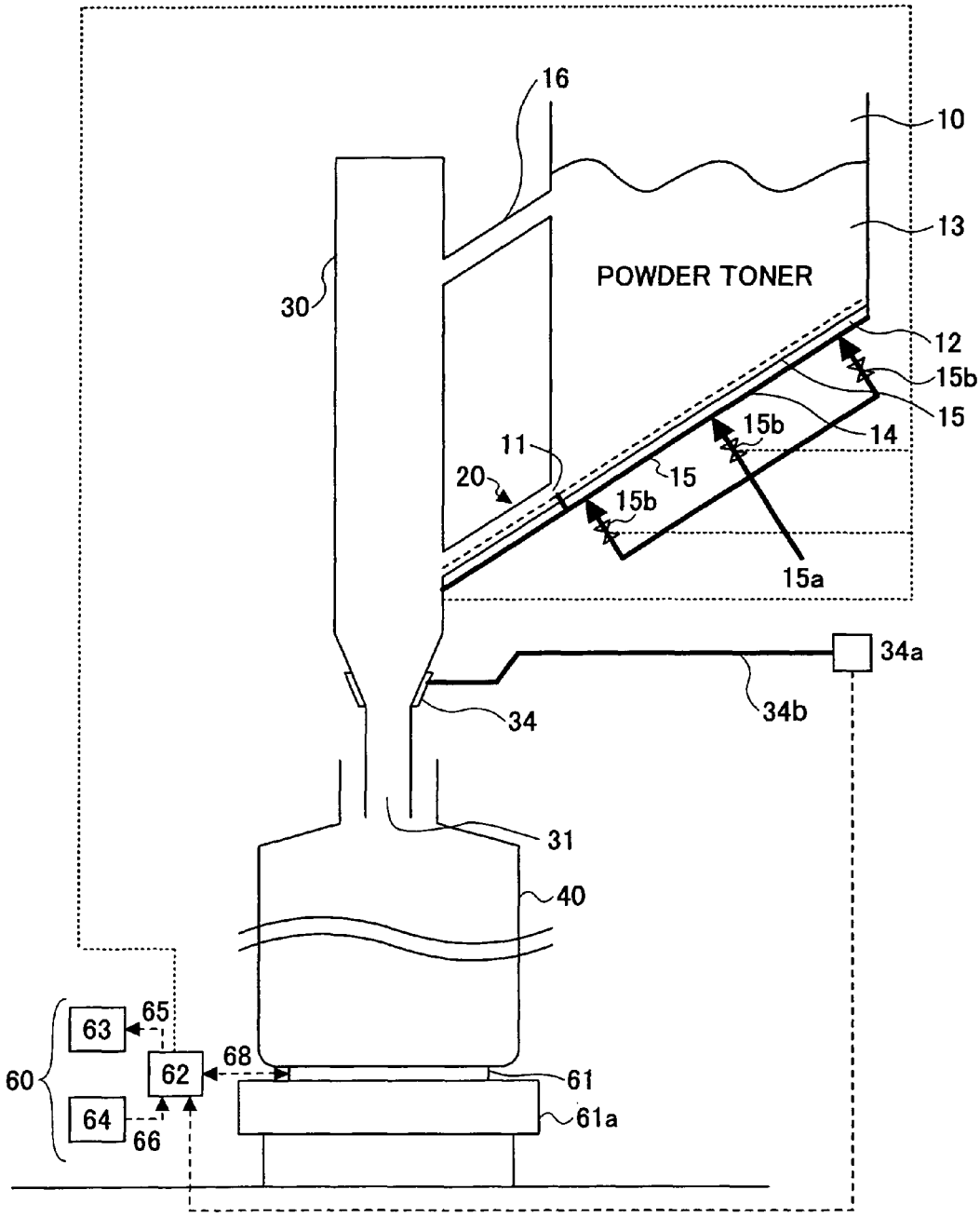
FIG. 2 is a cross-sectional view showing another example of the powder filling device.

The auxiliary container which is shown in FIG. 2 and disclosed in Japanese Patent Application No. 2003-070929 which is assigned to the assignee of this application can be used for the powder filling device in order to achieve the object of this invention.

Although a figure showing the state where the auxiliary container is disposed in the powder filling device of FIG. 2 is omitted, a description will be given of the filling amount control unit provided in the measuring tank in that case.

The filling amount control unit (34) is provided near the powder discharge port (31) of the measuring tank (30), and the filter material which passes a gas but does not pass the powder is used. If the measuring tank (30) is of the cylindrical body structure as shown in FIG. 2 and the upper part serves as diameter reduction structure from the part which has been a cylinder body, it is effective that the installation site of this filling amount control unit (34) is provided near the termination part of the diameter reduction part towards the powder discharge port (31) from the termination part of the diameter reduction part.

The gas suction unit (34*a*) which is connected with the filling amount control unit (34) and provided in the exterior of the measuring tank (30) is worked. At the same time, the gas existing between the powder particles in the measuring tank (30) is attracted and the gas is discharged through the gas suction pipe (34*b*) which connects the mesh part and the gas suction unit.

The toner powder attracted by the surface of the wall of this mesh part is set in the extracted state so that a powder group is formed. By adjusting suction pressure, the powder size of subgroup is changed. As a result, the filling amount of the powder is adjusted. One or more through holes are formed beforehand in the part in which the filling amount control unit is disposed. The filter material is fixed to close the through hole. The wall which forms a space part in the outside of the filter material fixing part and causes no gas leakage is provided. The through hole is provided so that the filter material is supported by the tubular body, and the hardness can be raised.

On the other hand, a gas exhausting port is provided in the above wall, and this gas exhausting port communicates with the gas suction unit.

Although the kind of the material which constitutes the above wall is not restrictive, it is preferred that the material of the wall is the same as the material used for the measuring tank. If only the above wall will be in the state where the gas attracted through the filter material does not leak, it can be formed partially around the periphery of the tubular body or fully around the perimeter of the tubular body.

The function of the filling amount control unit may be separated into two portions: a discharge stop function part and a discharge amount regulating function part in the order near the powder discharge port. By this composition, the adjustment of the gas suction pressure by the gas suction unit can be performed smoothly, a discharge stop function part and a discharge amount regulating function part so that the small powder container can be filled up with the given amount of the powder correctly and quickly.

Figure 3A:
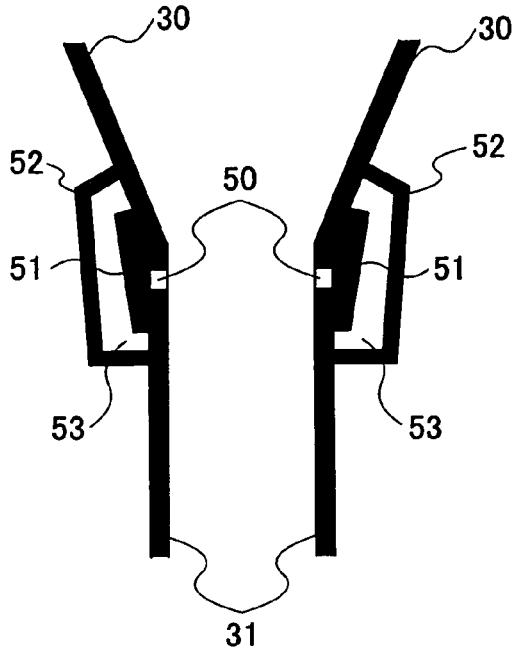
FIG. 3A and FIG. 3B are diagrams for explaining a filling amount control unit for use in the powder filling device of the present invention.

FIG. 3A shows the composition of the filling amount control unit when it is not separated into the two portions: the discharge stop function part and the discharge amount regulating function part.

In the filling amount control unit of FIG. 3A, the through hole (50) is provided near the powder discharge port (31) of the measuring tank (30), the filter material (51) is fixed to close this through hole (50), and the wall (52) which does not have a gas leakage is provided around the outside of the filter material (51) so that a space part (53) is formed.

Figure 3B:
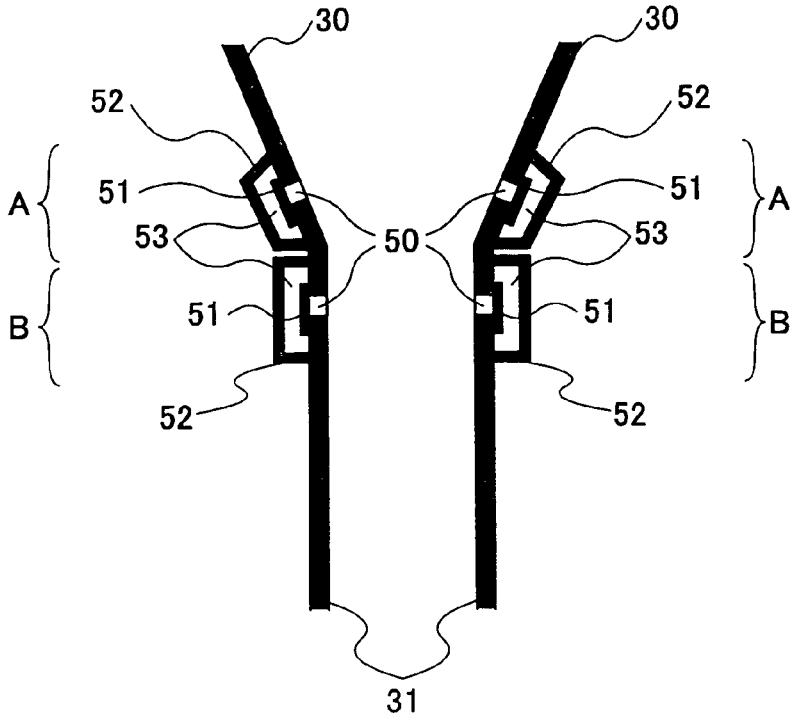

On the other hand, FIG. 3B shows the composition of the filling amount control unit when it is separated into the two portions: the discharge stop function part (A) and the discharge amount regulating function part (B). Each of the parts comprises the through hole (50), the filter material (51), the wall (52), and the space part (53) which are provided therein. If only this wall (52) will be in the state where the gas attracted through the filter material (51) does not leak, the wall may be formed either partially in the perimeter of the tubular body part or all around the tubular body part.

It is effective that the filling amount control unit is formed by wrapping the portion of 60% to 100% of the circumference of the tubular structural body with the 5 to 50 mm wide filter material. It is preferred that the filter material is formed in a twill weave as a filter material which has a function which air passes and a toner powder does not pass. And a filter material formed in a twill weave with mesh 500/3500 is still more preferred.

It is preferred to use a filling amount control unit which comprises a layered product of two or more filter material sheets with different meshes. And it is effective for the filling amount control unit that the layered product includes a filter material of a fine mesh which is disposed on the inner core part side of the tubular body part.

The gas suction unit which is connected with the filling amount control unit is not limited, and a vacuum pump suction type, an ejector mechanism suction type, etc. may be used. Among these, the ejector mechanism suction type is desirable from a viewpoint that it hardly needs the maintenance.

In addition, the suction pressure obtained by the gas suction unit is not limited. For example, the suction pressure in the range of −5 to −50 kPa is desirable since the filling amount is effectively controllable. The regulation of the suction pressure can also be carried out by providing a control valve (not illustrated).

Although the powder from the measuring tank to the powder filling container can adjust the internal pressure and the flow speed of the filling amount control unit part in the measuring tank and it can be stopped, it is preferred to make the bulk density of the powder in that case become 0.4 to about 0.5.

Although the filling amount control unit used for the powder filling device of the invention is not limited to the above-described two examples, if these filling amount control units are used, mechanical stress is not given to the powder. Especially the flowability of the toner is increased, desorption of the additive (external additive) adhering to the surface of the toner does not take place easily. It becomes difficult that the cohesion takes place in the case of the toner for low-temperature fixing which contains the low melting point resin. The characteristics of the toner are not reduced, and due to adhesion of the toner to the discharge opening, the discharging of the toner into the container is not barred. The filling work can be performed efficiency.

The 1st powder fluidization unit (15) in FIG. 4 has a number of fine holes for spouting a gas, and has a gas introducing pipe (15*a*) which introduces a pressurized gas to the porous body in which the fine holes are mutually open for free passage inside.

In the device of this embodiment, the porosity sintering object having the smooth surface is used. Although not illustrated, in order to prevent the dust explosion of the fluidized powder, the discharge unit for discharging the generated static electricity is provided in the toner filling device of this embodiment.

As shown in FIG. 4, the movement amount of powder has a range proportional to a blowing-in air amount, and adjusting the supply quantity of gas can make the movement amount mostly constant. When the same gas jet material is used, the area of each powder fluidization unit (15) and the size of the hole parts greatly affect the quantity of gas which can be supplied.

In the filling device of this invention, the measuring tank (30) may be provided with a pressure control unit (not illustrated) which controls the internal pressure of the measuring tank. Alternatively, this pressure control unit may be instead provided in the powder fluidization hopper (10), or it may be attached to the powder fluidization hopper (10).

Such a pressure control unit is used to regulation of the powder fluidization hopper in the state where the gas is sent from the powder fluidization unit (10) and/or the pressure state in the measuring tank (30), and the toner cloud state.

In the powder filling device of this invention, it is preferred that a filling powder weight managing unit for managing the amount of filling powder to the powder filling container (40) is provided. The filling powder weight managing unit (60) in this embodiment has a load cell (61) for measuring the filling powder weight, and the powder filling container (40) is laid on the load cell (61).

The load cell (61) is provided on the lifter (61*a*) for moving up and down this load cell and for changing suitably the gap between the auxiliary container (70) and the powder filling container (40). The monitor unit (63) for displaying the measured filling powder weight is provided on the load cell (61).

Before the powder filling device is operated to start the filling work, the auxiliary container (70) is moved up or down and fixed to the suitable position between the auxiliary container (70) and the powder discharge port of the measuring tank (30) by the auxiliary container rising/falling unit (73).

The above-mentioned monitor unit (63) may be the known indication unit which can display the measured weight based on the voltage signal from a pressure-receiving detection unit which detects the voltage which is changed according to the degree of the elastic deformation of the received weight or pressure, or based on the output signal from a pressure detection element, such as a piezoelectric element, wherein the electromotive force is directly changed according to the received pressure. While the weight displayed on the monitor unit (63) is seen the filling amount of the powder is checked, so that the powder filling for the container can be performed or completed.

Although it is not indispensable in this invention, the filling powder weight managing unit (60) in the powder filling device of this embodiment may comprise a computation processing unit (62) which computes a filled-up powder weight based on an empty weight of the powder filling container (40) on the load cell (61) and a gross weight of the powder filling container (40) which is filled up with the powder.

And the computation processing unit (62) has an input unit (64), and while the weight displayed on the monitor unit (63) is referred to, the initial filling weight of the powder is inputted by using the input unit (64), and the inputted initial filling weight can be changed by the input unit 64.

Based on the operation result, the computation processing unit (62) transmits a command signal to the gas suction unit. The suction pressure by the gas suction unit can be adjusted, and the filling amount of the powder can be regulated.

As the computation processing unit (61), any of various control units including the CPU of a microcomputer chip and an analog voltage comparator may be used. In the case of the analog voltage comparator, an AD converter which converts the input voltage into a pulse signal according to predetermined voltage change must be attached.

The input unit (64) in this embodiment is a button/rotation knob of the digital switch as a code generator (binary code). When the computation processing unit (62) is constituted by the CPU, the input unit (64) may be constituted by the keyboard. And, in that case, the CPU comprises the RAM in which various data containing the measured weight are stored (based on the result of the operation and/or the result of the input signal from the input unit) and the data are rewritable, and the ROM in which various programs including the processing program are stored for carrying out the operation of the RAM which indicates the operation result one by one again, and this various data, and one of various request information dispatch programs enable the free call can be attached.

The computation processing unit (62) can be configured to include the program which transmits the opening/closing command signals to the flow control valves (21*b*) and (15*b*) and the suction control valve (33*b*) based on the operation results.

In the powder filling device of this invention, when the powder accumulation amount on the side of the outlet of the powder fluidization hopper increases, the resistance of the air becomes large and the transfer rate of the powder in the connecting tube becomes small. There is a case in which the powder delivery is stopped automatically.

The fluidization of the powder prevents this problem from arising, but it is necessary to adjust the degree of expansion of the powder layer (or the size of the powder clouds) to a given degree (20%-500%) of the depth of the powder layer by sending air to the powder fluidization hopper. When the degree of expansion is smaller than the given degree, smooth discharge cannot be performed easily. When it is larger than the given degree, the local whirling or blowing up of the powder may occur in the inside of the container and such it is not desirable.

It is preferred to adjust the degree (the size of the powder clouds) of expansion of the powder layer in the measuring tank to the given degree (25%-600%) of the depth of the powder layer. As a unit which raises the bulk density of the fluidized powder layer, the air slide block of a porosity plate may be used. The air slide block of the porosity plate is divided and the supply air is sent intermittently, and the powder which is be made in the shape of a pulse can be delivered.

The powder filling device of this invention can be applied to any kind of powder, but it is especially effective for the toner for electro photographic printing method. And the kind of the toner is not restrictive, and, for example, a 2-component nonmagnetic black toner, a 1-component nonmagnetic color toner, a 1-component nonmagnetic black toner, or a 1 component magnetic black toner can be used.

The powder filling device of this invention can be located for use in a toner production factory, or near the copying machine within a storage/shipment section or office. When the powder filling device of this invention is located near the copying machine, it is desirable that a pressure container as a source of gas supply is provided on a cart with wheels. And a compressor can be attached to the pressure container to store compressed air in the pressure container.

The filling work of the powder using the powder filling device of this invention is usually performed as follows. The powder in the powder fluidization hopper is always set in the fluidized state, and the weight of the powder filling container itself is measured. The powder filling container is installed in the auxiliary container, and the powder filling container is filled up with a given amount of the powder. This process is repeatedly performed, and a plurality of powder filling containers which are filled up with the powder are produced.

Next, the example using the toner for electro photographic printing method will be explained concerning the powder filling device and method in the present embodiment of the invention in which the auxiliary container is installed in the powder filling device shown in FIG. 2.

1. Toner Fluidization in Powder Fluidization Hopper (1) The powder fluidization hopper and the toner used Volume of the powder fluidization hopper (10): 60 [liter]

The kind of the toner: 2-component nonmagnetic black toner (external additive adhesion toner) (Type 8000 toner for the Ricoh color laser printers, average volume particle size: 7.0 micrometers, true specific-gravity: 1.2)

The amount of the toner: 20 [kg]

Filling method: Fluidization falling type (2) The material which constitutes the fluid bed of the toner fluidization unit Material: porosity polyethylene, thickness: 5 mm Porosity contents: average hole diameter: 10 [micrometer], porosity ratio: 30 [%]

(3) Fluidization of the toner

Time from air introduction start to uniform state: 5 [min]

Introduction of air: air is sent from the whole surface of the toner contact surface while no escape of air from the lateral is checked.

Speed of air (the flow rate of air balanced in the state where the toner powder surface stays): 900 ml/200 cm2 by 1 min [air flow rate per unit time by unit area of the fluid bed]

(4) The observation of a fluidized state

Bulk density: (0.2-0.3 [g/cc])

(which is the apparent bulk density containing air, and it is confirmed that it becomes high as the neighborhood of right above the fluid bed but becomes low as it separates from it)

Homogeneity of the flow: the uniform state is checked by viewing it from the upper part.

3. Powder Delivery Process to Measuring Tank

After the valve on the side of the gas introducing pipe is opened and pressure is externally supplied, the valve is closed to stop the supply of the external pressure, and the toner in a fluidized state is delivered to the measuring tank.

4. Specifications of Measuring Tank

The measuring tank has the cylindrical body made of a stainless steel and having a powder discharge port wherein the diameter from the middle thereof is enlarged. The whole length: 400 mm, the diameter of the broad part: 100 mm, the diameter of the powder discharge port: 10 mm, the length from the powder discharge port to the enlarged part: 80 mm, the angle of the enlarged part: 70 degrees, and the filling amount control unit from, and the installed position from the powder discharge port of the filling amount control unit: 50 mm.

The filling amount control unit:

the unit provided with the discharge amount regulating-function part (A) and the discharge stop function part (B) (FIG. 3B)

the discharge amount regulating-function part (A) and the discharge stop function part (B) wherein four through holes are provided on each circumference of the respective cylinder bodies at equal intervals, and a 10-mm-wide stainless steel mesh (twill weave, mesh 500/3500) is wound around the circumference of the part (B) and a 30-mm-wide stainless steel mesh (twill weave, mesh 500/3500) is wound around the circumference of the part (A).

The wall made of a stainless steel wherein a space part in the circumference of the outside of each filter material and does not have gas leakage is formed, and the gas exhausting port is further formed in this wall.

Two ME-60 units (the product from Koganei Co.) are used as the gas suction unit, and each gas exhausting port is connected to one gas suction unit.

5. Delivery to Auxiliary Container

Specifications of the Auxiliary Container:

The funnel-shape container made of polyester with the nozzle made of sponge attached to the outlet, the diameter of the conical bottom: 165 mm, the whole length: 280 mm, the diameter of the tubular-body part where the outlet is provided: 11 mm, the angle (theta) of the conical top of the auxiliary container: 60 degrees.

Installation of the Auxiliary Container:

Before starting the filling work, it is set up and fixed to a given position where the center of the conical bottom of the auxiliary container almost matches with the powder discharge port of the measuring tank, by using the auxiliary container rising/falling unit.

6. Filling to Powder Filling Container

Specifications of the Powder Filling Container:

Diameter: 100 mm, length: 200 mm, volume: 1560 cc, the container made of polyester and having the opening with a diameter of 20 mm.

(2) Filling Work

The load cell is used as the weight managing unit, and the empty powder filling container (40) in which no powder is contained is placed on the load cell (61), and the empty weight of the container is measured. After this, the lifter (61*a*) is used to move up the container until the powder discharge port (31) of the measuring tank is inserted into the opening of the powder filling container so that the container is set at a given position.

The toner which is fluidized within the powder fluidization hopper (10) and introduced into the measuring tank (30) is dropped to the powder filling container (40) from the powder discharge port (31) at the flow rate conditions of 55 g/sec. When the filling amount of the toner in the container becomes 90% of a given amount, the suction unit connected with the discharge amount regulating-function part (A) in the filling amount control unit of the measuring tank is operated at −15 kPa, and the flow rate condition is reduced to 5 g/sec, so that the filling work of the toner is completed.

When the toner filling work of one powder filling container is completed, the suction unit connected with the discharge stop function part (B) in the filling amount control unit of the measuring tank is operated to stop the falling of the toner. After the following powder filling container is placed to the measuring tank, operation of the suction unit connected with the discharge stop function part (B) is stopped so that the falling of the toner is started. The toner filling work is performed similarly. The process including a series of the filling work is repeatedly performed, and a plurality of powder filling containers which are filled up with the toner powder are produced.

The repetitive filling work is performed by making the powder in the powder fluidization hopper always in a fluidized state.

6. Effects of the Powder Filling Device of the Invention (1) Filling Speed: 15 sec (550 g/one Container)

The filling density of the toner in the powder filling container: 0.38 g/cc (3) State of the External Additive of the Toner after Filling:

The SEM photograph showing the separation state and the burial state of the external additive is observed by comparison with the state before filling, and it is confirmed that the external additive adheres to the toner particle surface normally.

(4) Image Obtained with the Toner after Filling:

As a result of carrying out continuation printing of the image on 20000 sheets with Ricoh color printer, Ipsio Color 8000 using the toner after filling, all the sheets are printed without development of a poor image, such as greasing.

Next, the 2nd preferred embodiment of the invention will be explained.

In the powder filling device of this embodiment, the measuring tank has the powder discharge port and the filling amount control unit disposed near the powder discharge port. The auxiliary container has the gas permutation unit disposed on the underside of the powder discharge port of the measuring tank which faces downward. The powder externally delivered to the measuring tank is discharged from the powder discharge port into the powder filling container disposed on the underside of the auxiliary container while the filling amount of the powder is controlled by the filling amount control unit, and the powder is temporarily dropped to the auxiliary container, and further dropped to the powder filling container so that the powder filling container is filled up with the powder.

Therefore, the flow rate of the powder is made stable, and as a result it is possible to fill up the powder filling container with the powder for a short time while preventing the powder from being leaked or dispersed during the filling work. By using the gas permutation unit provided in the auxiliary container, the gas existing between the powder particles once collected in the powder filling container is returned to the auxiliary container. As a result, making the powder filling container full of the gas is avoided. When compared with the case where such auxiliary container is not used, the filling speed can be shortened to 40 to 60%.

The above-mentioned powder filling device may be configured so that the auxiliary container is of a conical funnel-like type, a leading edge of the conical funnel-like auxiliary container is provided with a cylindrical body having a powder outlet and being inserted into an opening of the powder filling container, and a cone bottom of the conical funnel-like auxiliary container is provided with an opening part in which the powder discharge port of the measuring tank is inserted.

The above-mentioned powder filling device may be configured so that the gas permutation unit is provided in the conical funnel-like auxiliary container, and the gas permutation unit comprises a gas ventilating pipe which is disposed and fixed to extend from a position near the powder outlet of the auxiliary container to an upper part of the auxiliary container.

The above-mentioned powder filling device may be configured so that the gas ventilating pipe is formed integrally with the auxiliary container.

The above-mentioned powder filling device may be configured so that an angle of a conical top part of the auxiliary container is in a range of 50 to 70 degrees.

The above-mentioned powder filling device may be configured so that the powder filling device further comprises a rising/falling unit provided for moving up and down the auxiliary container.

The above-mentioned powder filling device may be configured so that the filling amount control unit is provided with at least three filling functions of free powder discharging, powder discharge stopping, and partial powder discharging.

The above-mentioned powder filling device may be configured so that the measuring tank is formed with a tubular body which extends from a position where the filling amount control unit is disposed to a position of the powder discharge port.

The above-mentioned powder filling device may be configured so that the filling amount control unit comprises an elastic body ring fixed to the powder discharge port of the measuring tank, and a discharge control unit which controls discharging of the powder from the powder discharge port, wherein the discharge control unit comprises a discharge amount control member which is mounted on a discharge control lever which is moved up and down within the measuring tank, and wherein the discharge amount control member comprises a conical-shape member which opens and closes the powder discharge port by separation of the conical-shape member from the powder discharge port and insertion of the conical-shape member to the powder discharge port.

The above-mentioned powder filling device may be configured so that a degree of opening/closing of the powder discharge port is adjusted by a degree of insertion of the conical-shape member to an opening of the elastic body ring which depends on a degree of an up/down movement of the discharge control lever within the measuring tank.

The above-mentioned powder filling device may be configured so that the filling amount control unit is made of a filter material which passes a gas and does not pass the powder, and the powder is drawn to the filter material by using a gas suction unit communicating with the filling amount control unit, so that the filling amount of the powder is controlled according to a degree of suction of the powder by the gas suction unit.

The above-mentioned powder filling device may be configured so that the filling amount control unit is provided so that the filter material is fixed to close a through hole formed in a tubular body part of the auxiliary container, and a wall which does not have a gas leakage is provided around an outside of the filter material so that a space part is formed.

The above-mentioned powder filling device may be configured so that the filter material is formed in a twill weave.

The above-mentioned powder filling device may be configured so that a powder fluidization hopper which is connected with the measuring tank is provided, and, after the powder in the powder fluidization hopper is delivered to the measuring tank temporarily, the powder in the measuring tank is delivered to the powder filling container.

The above-mentioned powder filling device may be configured so that the powder fluidization hopper comprises an inclined inside wall portion, and the powder inside the powder fluidization hopper is sent to the powder outlet by the inclined inside wall portion.

The above-mentioned powder filling device may be configured so that the powder fluidization hopper comprises a powder fluidization unit, and the powder in the powder fluidization hopper is fluidized with a gas sent from the powder fluidization unit, and the fluidized powder is sent to the measuring tank.

The above-mentioned powder filling device may be configured so that the powder fluidization unit is provided with a gas introducing pipe attached thereto, and the gas introducing pipe introduces a pressurized gas to a porous body which has a number of fine holes for spouting a gas, and the fine holes communicate with each other inside the porous body.

The above-mentioned powder filling device may be configured so that the powder fluidization unit is disposed at the inclined inside wall portion.

The above-mentioned powder filling device may be configured so that the connecting tube has a downward inclination such that the powder fluidized with the gas sent from the gas introducing pipe is delivered from the powder fluidization hipper to the measuring tank through the connecting tube.

The above-mentioned powder filling device may be configured so that a filling powder weight managing unit is provided for managing the filling amount of the powder to the powder filling container.

The above-mentioned powder filling device may be configured so that the filling powder weight managing unit comprises a computation processing unit which computes a filled-up powder weight based on an empty weight of the powder filling container on a load cell and a gross weight of the powder filling container which is filled up with the powder.

The above-mentioned powder filling device may be configured so that a powder feed hopper which supplies the powder to the powder fluidization hopper is provided, and a leading edge of a cylindrical part of the powder feed hopper where the powder is supplied is arranged so that the leading edge is buried in a surface portion of a powder layer of the powder fluidization hopper.

It is preferred that a funnel-like auxiliary container wherein the gas permutation unit is provided is used in the above-mentioned powder filling device.

Next, the second preferred embodiment of the invention will be described in detail using the accompanying drawings.

FIG. 4 shows the embodiment of the powder filling device of this invention in which an auxiliary container is installed in the powder filling device shown in FIG. 1.

In the powder filling device of FIG. 4, after the measuring tank (30) transfer is carried out, the powder in the powder fluidization hopper (10) is once discharged to the auxiliary container (70), and the powder filling container (40) is filled with the powder from the auxiliary container (70).

The powder fluidization hopper (10) and the measuring tank (30) communicate with each other through the connecting tube (20) between the powder outlet (11) of the powder fluidization hopper (10) and the powder inlet of the measuring tank (30). In the measuring tank (30), the powder discharge port (31) and the filling amount control unit (32) are provided, and the powder discharge port (31) is opened or closed, so that only a given amount of the powder is discharged into the auxiliary container (70), and the powder filling container (40) is filled up with the powder.

As shown in FIG. 4, a conical funnel-like container is suitable as the auxiliary container (70), and the container (70) in which the gas permutation unit (74) is provided is used, and the conical bottom (71) of this auxiliary container (70) receives the powder breathed out. The cylinder part (72) which is installed just under the measuring tank (30) and has the outlet (72*a*) of the auxiliary container (70) is inserted into the opening of the powder filling container (40), and this auxiliary container and the powder filling container are installed.

The size of the respective parts of the funnel-like auxiliary container is not restrictive. For example, it is preferred that the diameter of the conical bottom is in the range of 130 to 180 mm. The material of the auxiliary container is preferably translucent such that the discharge state of the internal powder in the container can be observed. The tubular body part edge of the funnel-like auxiliary container is made of a cushion-like sponge if it fixes by sticking the nozzle (packing) which comprises the quality of the material and an outlet is formed. If the opening of the powder filling container installs the auxiliary container and the powder filling container as it hits this nozzle, and an impact can be eased.

In order to exchange the powder filling container (40) filled up with the powder of a given amount with another powder filling container, the auxiliary container (70) is moved up or down by the rising/falling unit (73). And the powder which fell out of the measuring tank and with which this auxiliary container (70) is once covered is further dropped into a powder container, and a gas is full which repeats it, and a powder container.

This gas is re-circulated in the auxiliary container (70) by the gas permutation unit provided in the auxiliary container (70), the effect of shortening the time of powder filling will be brought about.

Using FIG. 5, an example of the auxiliary container (70) in which the gas permutation unit (74) is provided will be explained.

The powder discharge port (31) at the edge of the measuring tank (30) is inserted in the opening (71*a*) of the conical bottom (71) of the auxiliary container (70). The cylinder part (72) which is installed and has an outlet (72*a*) of this auxiliary container (70) is installed so that it may intercalate in the opening (41) of the powder filling container (40). The gas permutation unit (74) is provided in the auxiliary container (70). This gas permutation unit (74) comprises the ventilating pipe (74*a*), one vent (74*b*) is formed in the circumference of the outlet (72*a*) of the auxiliary container (70), and the vent (74*c*) of another side is formed in the upper part of the conical wall part (75) of the auxiliary container (70) respectively.

The shape of the ventilating pipe part (74*d*) of the part neighborhood which changes to a cylinder part (72) from the conical wall part (75) of this auxiliary container (70) is stuck on the nozzle (76) parallel to a conical bottom (71) which makes it a plane mostly and becomes the circumference of a plane portion from cushioning-properties material.

When this nozzle (76) installs a powder filling container, it has a function which softens the impact by the opening (41) of that powder filling container (40), and builds the sealed state of an auxiliary container and a powder container. About the powder fluidization hopper (10), as disclosed in Japanese Patent Application No. 2002-020980 mentioned above, and all the conditions of the large-sized container explained previously can be applied.

The powder fluidization hopper (10) has the inside wall portion (12) which is inclined in the degree which does not bar slipping down of the powder stored inside, and discharge to the outlet (11) of the powder stored by this inclined inside wall portion (12) inside is carried out smoothly.

In the powder filling device of this embodiment, the inclined inside wall portion (12) is a part of the hopper-shape structural portion (13) at the lower part of the powder fluidization hopper (10). It is possible to make the powder fluidization hopper (10) and the measuring tank (30) connect with the top connecting tube (16) provided in the upper part of the connecting tube (20). The top connecting tube (16) is inclined downward toward the measuring tank (30) from the powder fluidization hopper (10).

Some reasons of the part communicating pipe (16) having had a role which keeps the pressure in a measuring tank (30) equal to the pressure in a powder fluidization hopper (10), and also there having been too much quantity of the jet gas from the 1st powder fluidization unit (15). When larger toner clouds than a request are formed into the measuring tank (30), the powder grains to accompany can be returned to a measuring tank (30) by being able to extract a superfluous gas in a powder fluidization hopper (10), and inclining downward with this top communicating pipe (50).

The powder discharged from the powder outlet (11) of the powder fluidization hopper (10) bottom is sent to a measuring tank (30) through a connecting tube (20). This connecting tube (20) forms a part of the base part. The fluidization unit (not shown) of the length direction which the whole surface is covered mostly, and an introductory gas blows off comprises an air slide block of a porosity plate can be provided.

The gas sent from this fluidization unit fluidizes further the powder moved to the measuring tank (30) from the connecting tube (20), and makes the discharge to the measuring tank of powder quicken.

The connecting tube (20) is inclined downward toward the measuring tank (30), and slipping down to the measuring tank (30) of the fluidized toner is assisted by this.

Next, the measuring tank will be explained.

The kind of the material of the measuring tank is not restrictive, and the metal, such as stainless steel, titanium, and aluminium, or the product made of plastics is also applicable. From the filling amount control unit installation site to a powder discharge port, the whole comprises tubular structure (it is called a tubular body), and especially the thing of a cylinder type is used preferably.

It is preferred that the path uses what is about 50-200 mm, and it is preferred that the path of the powder discharge port of the measuring tank (30) uses what is about 5-15 mm. It is needless to say that the powder discharge port and the opposite side are closed. What explained FIG. 1 previously is used as the filling amount control unit (32) in the filling device shown in FIG. 4. The filling amount control unit (32) comprises the elastic body ring (32*a*) which has the discharge opening (31), and the discharge control unit (32*b*) which controls the discharge of the toner from the powder discharge port (31). The discharge control unit (32*b*) comprises the discharge control member (32*d*) with which the discharge control lever (32*c*) which moves up and down the inside of the measuring tank (30) is equipped, and the discharge control member (32*d*). The member of the conical shape is inserted to or separated from the powder discharge port (31), and opens and closes this powder discharge port (31), and the degree of opening/closing of the powder discharge port (31) is adjusted by the degrees of insertion degree to the powder discharge port (31) of the elastic body ring (32*a*) of the discharge control member (32*d*) of conical shape depending on the degree of the up/down movement and the degree of fitting of the discharge control lever (32*c*) within the measuring tank (30).

The fundamental function of the filling amount control unit (32) in the filling device shown in FIG. 4 to regulate the filling amount of powder according to the degree of opening/closing of this powder discharge port (31). The auxiliary container can be used for the powder filling device disclosed in Japanese Patent Application No. 2003-70929 and which is shown in FIG. 2, and the object of this invention can be solved.

Although the figure showing the state where the auxiliary container is applied in the powder filling device of FIG. 2 is omitted, the filling amount control unit provided in the measuring tank in that case is explained in detail.

The filling amount control unit (34) is provided near the powder discharge port (31) of a measuring tank (30), and the filter material which a gas passes and powder does not pass is used. It is effective, if the upper part serves as diameter reduction structure from the part which has been a cylinder body and the installation site of this filling amount control unit (34) is provided near the termination part diameter reduction towards a powder discharge port (31) from the termination part of diameter reduction in the case of the structure which is a cylinder body, as a measuring tank (30) is especially shown in FIG. 2.

If the gas suction unit (34*a*) which is connected with the filling amount control unit (34) and which is provided in the exterior of the measuring tank (30) is worked, at the same time the gas which exists between the powder in a measuring tank (30) is attracted and a gas is discharged through the gas suction pipe (34*b*) with which this mesh part and a gas suction unit are connected. The toner powder attracted by the surface of a wall of this mesh part extracts, it will be in a state, and a powder group is formed, by adjusting suction pressure, the powder size of subgroup is changed and, as a result, the filling amount is adjusted.

The plurality of through holes are provided in the tubular body itself beforehand, and the filling amount control unit has the wall that it is fixed like, and a space part is formed in the outside of this charge of filter material fixed part, and there is no gas leakage is provided.

The filter material can become what is supported by the tubular body, and hardness can raise this through hole. On the other hand, the gas exhausting port is provided in this wall, and it is made to have opened this gas exhausting port for free passage with the gas suction unit.

Although the quality of the material which constitutes this wall is not restrictive, it is preferred that it is the same as the quality of the material used for a measuring tank. If only this wall will be in the state where the gas attracted through the filter material does not leak, it can be formed even in a perimeter enclosure also around the tubular body. The filling amount control unit in the order near the powder discharge port is divided into two portions of the discharge stop function part and the discharge amount regulating-function part.

If it provides, since it can be filled up with the predetermined amount of powder in a small powder container correctly and quickly, without what adjustment of the gas suction pressure by a suction unit can carry out smoothly, and suction pressure is too strong and is got blocked happening.

FIG. 3A shows the section key map of the filling amount control unit setting part when not dividing the filling amount control unit into two portions of a discharge stop function part and the amount regulating-function part of discharge.

The through hole (50) is provided near the powder discharge port (31) of the measuring tank (30), and the through hole (50) is closed by the filter material (51) fixed, and the wall (52) which does not have gas leakage in the outside of the filter material (51) further is provided so that a space part (53) may be formed.

FIG. 3B shows the case of the filling amount control unit is divided into two portions of the discharge amount regulating-function part (A), and the discharge stop function part (B), and the through hole (50), the filter material (51), the wall (52), and the space part (53) are provided in each.

If only this wall (52) will be in the state where the gas attracted through the filter material (51) does not leak, it can be formed even in a perimeter enclosure also around the tubular body. As for the filling amount control unit, it is effective to form it at the 5-50-mm-wide charge of a filter material, as 60%-100% of portion of the circumference of a tubular structure object is rolled.

The filter material formed in a twill weave is preferred as the filter material which has a function which air passes and a toner powder does not pass. And a filter material formed in a twill weave with mesh 500/3500 is still more preferred.

The filter material of a fine mesh is effective as what is used for the filling amount control unit as it is preferred to use what comprised a layered product of the filter material of two or more sheets from which a mesh differs and it is on the inner core part side of a tubular body as this layered product.

As the gas suction unit which makes connect with this filling amount control unit, and is used, although not limited, a vacuum pump suction type, an ejector mechanism suction type, etc. are used, for example, and it is desirable at the point that an ejector mechanism suction type hardly needs maintenance. Although not limited for the suction pressure obtained by this gas suction unit, if it draws in about −5--50 kPa, since the filling amount is effectively controllable.

Regulation of the suction pressure can also be carried out by providing a control valve (not illustrated). Although the powder from a measuring tank to a small filling device can adjust the internal pressure and the flow speed of a filling amount control unit part in a measuring tank and it can be stopped, it is preferred to make the bulk density of the powder in that case become 0.4 to about 0.5.

As the filling amount control unit used for the filling device of this invention, mechanical stress will not start powder if these filling amount control unit illustrated especially are used, although not limited to two kinds of things explained above. Desorption of the additive (external additive) made to adhere to the surface in order to increase especially the flowability of toner etc. does not take place easily.

It is possible to become difficult to generate the cohesion also in the case of the toner for low-temperature fixing which made low melting point resin contain, not to reduce the characteristics of toner to it, and to adhere to a discharge opening, not to bar discharge to a container, and to raise filling work efficiency.

The 1st powder fluidization unit (15) in FIG. 4 has a number of fine holes for spouting a gas, and each fine hole has a gas introducing pipe (15*a*) which introduces a pressurized gas to the porous body which is mutually open for free passage inside.

In the powder filling device of this embodiment, the porosity sintering object with the smooth surface is used. Although not illustrated, in order to prevent the dust explosion of the fluidized powder, in the toner filling device of this example, the discharge unit for discharging the generated static electricity is provided.

As shown in FIG. 4, the movement amount of powder has a range proportional to a blowing-in air amount, and adjusts supply quantity of gas. In the case where the size, the same gas jet material of area of each powder fluidization unit (15) are used although movement amount could be made into about 1 the quantity of gas which can be supplied it is related.

In the filling device of this invention, a pressure control unit (not illustrated) may be provided in the measuring tank (30) to control the internal pressure. Alternatively, this pressure control unit may be instead provided in the powder fluidization hopper (10), or it may be attached to the powder fluidization hopper (10).

Such a pressure control unit is used to regulation of the powder fluidization hopper in the state where the gas is sent from the powder fluidization unit (10) and/or the pressure state in a measuring tank (30), and a toner cloud state.

On the other hand, as for the filling powder weight managing unit in the powder filling device of this invention, it is preferred to have the filling powder weight managing unit (60) for managing the amount of filling powder to the powder filling container (40), and the powder filling container (40) is laid on it. It has the load cell (61) for measuring filling powder weight.

The load cell (61) is provided on the lifter (61*a*) for moving up and down this and changing suitably the gap of an auxiliary container (70) and a powder filling container (40). The monitor unit (63) for displaying the measured filling powder weight on a load cell (61) is provided. Before an auxiliary container (70) works a powder filling device and starts filling work, it is gone up and down and fixed to a suitable position by the auxiliary container rising/falling unit (73) between the delivery parts of the measuring tank (30). It is based on the voltage signal from a pressure-receiving detection unit which detects the voltage which changed according to the degree which receives and carries out the elastic deformation of weight or the pressure as such a monitor unit. Or it is based on the development signal from the pressure detection element, such as a piezoelectric element, into which an electromotive force is directly converted according to the received pressure, the known indication unit which can display the measurement weight can be used, the weight displayed on the monitor unit (63) is seen, and it is with an identification about the filling amount of the powder. The filling of the powder can be performed or ended.

Although it is not indispensable in this invention, the filling powder weight managing unit (60) in the powder filling device of this example may have a computation processing unit (62) which computes a filled-up powder weight based on an empty weight of the powder filling container (40) on a load cell (61) and a gross weight of the powder filling container (40) which is filled up with the powder.

And the computation processing unit (62) has an input unit (64), and referring to the weight displayed, for example on the monitor unit (63) by this input unit (64), the input of the initial filling weight of powder is performed and it can make an inputted change of initial filling weight.

Based on the operation result, the processing unit (62) can transmit a command signal to a gas suction unit, can adjust suction pressure, and can regulate the filling amount of powder. Various control units can be used to various CPUs which contain a thing like a microcomputer chip from an easy analog type voltage comparator as the computation processing unit (62). In the case of an analog type voltage comparator, of course, the AD converter according to predetermined electric potential difference changed into a pulse signal is attached.

Although the input unit (64) in this example is the button/rotation knob of the digital switch as a code generator (binary code), in providing the computation processing unit (62) to the CPU can consider it as a keyboard and in that case Of course, it stores possible to rewriting (based on the result of operation and/or the result of the incoming signal from an input unit) of the various data containing weight. It can calculate, and ROM stored for various programs including the processing program for carrying out operation treatment of RAM which stores an operation result one by one again, and this various data, and various invitation information dispatch programs enabling a free call can be attached.

The processing unit (62) can be constituted based on the operation result in what has a program which transmits the opening-and-closing command signal of the first to third flow control valves (21*b*) or (15*b*) suction control valve (33*b*).

In the powder filling device of this invention, when the powder alimentation by the side of the outlet of a powder fluidization hopper increases, resistance of the part air may become large, the transfer rate of the powder in a connecting tube may become small, and a transfer may stop automatically. The degree of expansion of the powder layer by sending air to the powder fluidization hopper although fluidization of powder prevents this (size degree of powder clouds), if large it should adjust to the degree (20%-500%) of the depth of the powder layer. If it is smaller than this, smooth discharge cannot be performed easily, and the inside of a container the local whirling or rising of the occurs and is not preferred.

As for the degree (size degree of powder clouds) of expansion of the powder layer in a measuring tank, it is preferred to adjust to the degree (25%-600%) of the depth of a powder layer. As a unit which raises the bulk density of the fluidized powder layer, the air slide block of a porosity plate is divided and supply air is sent intermittently, and it can be made the shape of a pulse which divided powder, and can also convey.

Although various powder application is possible for the powder filling device of this invention, it is effective for especially the toner for electro photography, and the kind is not restrictive, either, for example, 2 component nonmagnetic black toner, 1 component nonmagnetic color toner, 1 component nonmagnetic black toner, or 1 component magnetism black toner can be used for it.

The powder filling device of this invention is, when using it, for example near the copying machine, although it can be used in a toner production factory for example, near the copying machine in storage and a shipment section, and office, the compressor it to be desirable providing with the pressure pipe as a source of gas supply on a cart with an axle pin rake, and store compressed air in a pressure pipe can be attached.

The filling work of the powder using the powder filling device of this invention, usually, the powder in the powder fluidization hopper is always made in the fluidized state and the weight of the powder filling container itself is measured. The powder filling container is installed in the auxiliary container, and it carries out by filling up the powder filling container with the powder of a given amount, it carries out by repeating this process, and two or more powder filling containers with which it filled up with powder are produced can be carried out.

Next, the example using the toner for electro photographic printing method will be explained concerning the powder filling device in the present embodiment of the invention-in which the auxiliary container is installed in the powder filling device shown in FIG. 2.

1. Toner Fluidization in Powder Fluidization Hopper (1) The powder fluidization hopper and the toner used:

Volume of powder fluidization hopper (10): 60 [liter]

The kind of the toner: 2-component nonmagnetic black toner (external additive adhesion toner) (Type 8000 toner for the Ricoh color laser printers)

The Average Volume Grain Size: 7.0 Micrometers, True-Specific-Gravity: 1.2

The amount of toner: 20 [kg]

Filling method: Fluidization falling type (2) The material which constitutes the fluid bed of the toner fluidization unit Material: porosity polyethylene, thickness: 5 [mm]

porous contents: average hole diameter: 10 [micrometer], porosity ratio: 30 [%]

(3) Fluidization of the toner

Time from air introduction start to uniform state: 5 [min]

Introduction of air: air is sent uniformly from the whole surface of the toner contact surface while no escape of air from the lateral is checked.

Speed of air (the flow rate of air balanced in the state where the toner powder surface stays): 900 ml/200 cm2 by 1 min [air flow rate per unit time by per unit of fluid bed]

(4) The observation of the fluidized state

Bulk density: (0.2-0.3 [g/cc])

(which is the apparent bulk density containing air, and it confirmed that it becomes high as the neighborhood of right above the fluid bed but becomes low as it separates from it)

Homogeneity of the flow: the uniform state is checked by viewing it from the upper part.

3. Powder Delivery Process to Measuring Tank

After the valve on the side of the gas introducing pipe is opened and pressure is externally supplied, the valve is closed to stop the supply of the toner of the external pressure is stopped, and the toner in a fluidized state is delivered to the measuring tank.

4. Specifications of Measuring Tank

The measuring tank has the cylindrical body made of a stainless steel and having a powder discharge port wherein the diameter from the middle thereof is enlarged.

The whole length: 400 mm, the diameter of the broad part: 100 mm, the diameter of the powder discharge port: 10 mm, the length from the powder discharge port to the enlarged part: 80 mm, the angle of the enlarged part: 70 degrees, and the filling amount control unit to the installed position: 50 mm The Filling Amount Control Unit:

the used provided with the discharge amount regulating-function part (A) and the discharge stop function part (B) (FIG. 3B)

the discharge amount regulating-function part (A) and the discharge stop function part (B) wherein four through holes are provided on each circumference of the cylinder bodies at equal intervals, and a 10-mm-wide stainless steel mesh (twill weave, mesh 500/3500) is wound around the circumference of the part (B) and a 30-mm-wide stainless steel mesh (twill weave, mesh 500/3500) is wound around the circumference of the part (A).

The wall made of a stainless steel which forms a space part in the circumference of the outside of each filter material and does not have gas leakage is formed, and the gas exhausting port is further formed in this wall.

Two ME-60 units (the product from Koganei Co.) are as the gas suction unit, and each gas exhausting port is connected to one gas suction unit.

5. Delivery to Auxiliary Container

Figure 5:
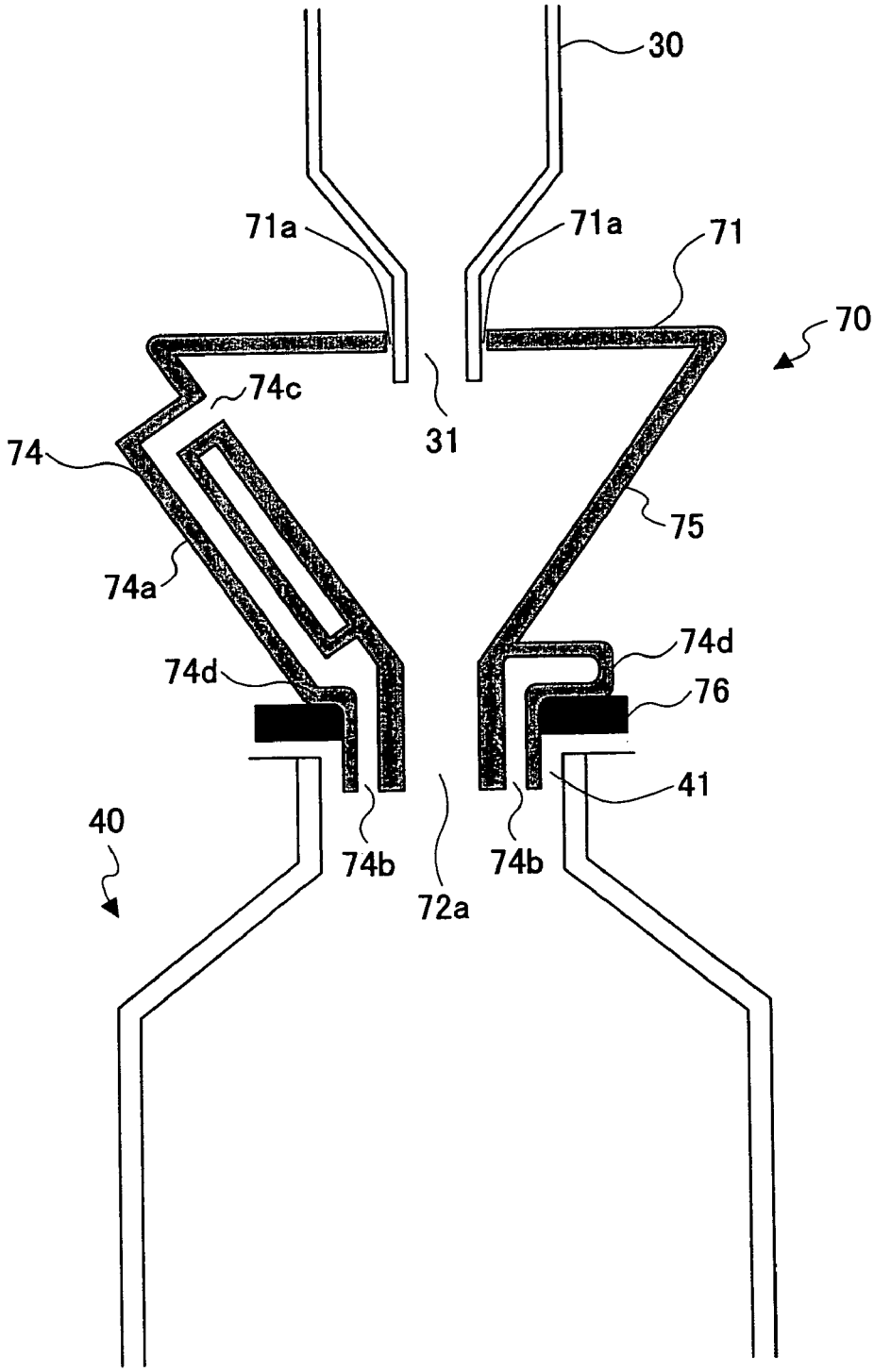
FIG. 5 is a diagram showing a funnel-like auxiliary container which has a gas permutation unit.

Specifications of the Auxiliary Container:

The Funnel-Shape Container Made of Polyester:

The nozzle made of sponge is attached to the outlet, and the gas ventilating pipe as the gas permutation unit as in FIG. 5 is penetrated in the upper part of the funnel-shape wall from near the outlet part of the tubular body part, and formed integrally.

The diameter of the cone bottom: 165 mm, the whole length: 280 mm, the diameter of the tubular body part where the outlet is provided: 11 mm, the angle of the conical top: 60 degrees.

Installation of Auxiliary Container:

Before starting the filling work, it is set up and fixed to a given position where the center of the conical bottom of the auxiliary container almost matches with the powder discharge port of the measuring tank by the auxiliary container rising/falling unit.

6. Filling to Powder Filling Container

Specifications of the Powder Filling Container:

Diameter: 100 mm, length: 200 mm, volume: 1560cc, the container made of polyester and having the opening with a diameter of 20 mm.

Filling Work

The load cell is used as the weight managing unit, and the empty powder filling container (40) in which no powder is contained is placed on the load cell (61), and the empty weight of the container is measured. After this, the lifter (61*a*) is used to move up the container until the powder discharge port (31) of the measuring tank is inserted into the opening of the powder filling container so that the container is set up at a given position.

The toner which is fluidized within the powder fluidization hopper (10) and introduced into the measuring tank (30) is dropped to the powder filling container (40) from the powder discharge port (31) at the flow rate conditions of 55 g/sec. When the filling amount of the toner in the container becomes 90% of the given amount, the suction unit connected with the discharge amount regulating-function part (A) in the filling amount control unit of the measuring tank is worked by −15 kPa, so that the flow rate condition is reduced to 5 g/sec at that time, and the filling work of the toner is completed.

If the toner filling work to one filling container is completed, the suction unit connected with the discharge stop function part (B) in the filling amount control unit of the measuring tank is worked to stop the falling of the toner. And the following small powder container is set to the measuring tank, and the operation of the suction unit connected with the discharge stop function part (B) is stopped to start the falling of the toner. The repetitive toner filling work is performed in a similar manner, and the toner filling work of a large amount of the toner is completed so that a large number of powder filling containers filled up with the toner are produced.

This repetition work is done by making the powder in the powder fluidization hopper into the fluidized state always.

6. Effects of the Powder Filling Device of the Invention (1) Filling Speed: 10 sec (550 g/one Container)

The filling density of the toner in the powder filling container: 0.38 g/cc (3) State of the External Additive of the Toner after Filling:

The SEM photograph showing the separation state and the burial state of the external additive is observed by comparison with the state before filling, and it is confirmed that the external additive adheres to the toner particle surface normally.

(4) Image Obtained with the Toner after Filling:

As a result of carrying out continuation printing of the image on 20000 sheets with Ricoh color printer, Ipsio Color 8000 using the toner after filling, all the sheets are printed without development of a poor image, such as greasing.

Next, the third preferred embodiment of the invention will be explained.

In the powder filling method of this embodiment, the powder filling device comprises the measuring tank which has the powder discharge port and the filling amount control unit disposed near the powder discharge port. The auxiliary container has the opening disposed on the underside of the powder discharge port of the measuring tank which faces downward. In the powder filling method, disposing the powder filling container is disposed on the underside of the auxiliary container, and the powder which is externally delivered into the measuring tank id discharged from the powder discharge port into the powder filling container while the filling amount of the powder is controlled by the filling amount control unit. The powder is temporarily dropped into the auxiliary container so that the gas existing between particles of the powder within the auxiliary container is freely discharged. Further, the powder is dropped into the powder filling container so that the powder filling container is filled up with the powder. It is possible that the powder in the powder feed hopper be supplied to the powder fluidization hopper and that the powder from the powder fluidization hopper be discharged to the powder filling container automatically continuously.

The powder supply mechanism for supplying the powder from the powder feed hopper to the powder fluidization hopper that can be performed automatically continuously will be explained using FIG. 6.

The fluidization portion (a) and the immobilizing portion (b) are formed in the surface (s) of the powder layer of the powder feed hopper (80). FIG. 6 shows the state at the time of installing the cylinder part (81) so that it may be buried in the immobilizing portion (b).

After closing the powder outlet (11) of the powder fluidization hopper (10), the powder in the powder feed hopper (80) is supplied to the powder fluidization hopper (10), if the powder fluidization unit (15) provided in the powder fluidization hopper (10) is worked and air is sent in after the powder in the powder fluidization hopper (10) reaches a predetermined quantity, the whole powder layer will be divided into the fluidization portion (a) and the immobilizing portion (b). When the fluidization portion (a) and the immobilizing portion (b) are formed in the surface (s) of the powder layer, the edge of the cylinder part (81) of the powder feed hopper (80) is installed so that it is buried in the immobilizing portion (i) of this surface. After this, the powder outlet (11) is opened. When the powder output is opened, the discharging of the powder takes place near the powder outlet (11). Subsequently, the powder of the fluidized state is discharged and the powder layer of the immobilizing portion (b) collapses. The powder of the immobilizing portion (b) of the quantity corresponding to the discharged amount of powder flows into a fluidization portion (a) from the interface (c).

The cycle that the powder in the powder feed hopper (80) corresponding to the quantity of the powder flow falls to the powder fluidization hopper (10) is repeated, and the powder is supplied to the powder fluidization hopper (10) automatically continuously from the powder feed hopper (80).

The powder which is supplied and fluidized in this way is continuously discharged from the powder outlet (11) of the powder fluidization hopper (10). Therefore, the powder fluidization hopper in which the fluidization unit is provided is used, and the powder in the powder feed hopper is supplied continuously without intermission in the powder fluidization hopper, and the state where the supplied powder is continuously discharged from the powder fluidization hopper can be recognized according to the powder continuous supply discharge method of the invention.

That is, according to the powder filling supplying system, as a result of movement of the small amount of powder between the fluidization portion and the immobilizing portion, the powder in the immobilizing portion moves to the lower part of the powder layer, and in connection with this, the natural falling of new powder to the powder fluidization hopper occurs, and the powder can be automatically supplied from the powder feed hopper.

Supply of the powder to the powder fluidization hopper from this powder feed hopper becomes superfluous, without needing a complicated mechanism. Without causing the problems that the powder will overflow from the powder fluidization hopper or that the supply of powder from the powder feed hopper to the powder fluidization hopper will stop, the continuous production of a large number of the powder filling containers and the continuous powder treatment of a large amount of the powder can be attained.

The spatial relationship of this powder outlet of the powder fluidization hopper and the immobilizing portion of the surface of the powder layer where the cylindrical part of the powder feed hopper is inserted is important for the continuation powder supply method of this invention.

Usually, the powder outlet (11) is provided in the end part of the bottom of the powder fluidization hopper. The immobilizing portion (b) of the surface (s) of the powder layer in which the powder outlet (11) and the cylindrical part of the powder feed hopper are inserted should be at the position distant from the powder outlet (11). This is effective in order to supply the powder from the powder feed hopper to the powder fluidization hopper automatically continuously. Therefore, it is effective to insert the cylindrical part above the position near the end (e) of the bottom (14) which is opposite to the position where the powder outlet (11) is provided. Namely, it is preferred to form the immobilizing portion so that the cylindrical part can be inserted.

In this case, the immobilizing portion in which the cylindrical part of the powder feed hopper is inserted, and it is important that the surrounding immobilizing state is maintained at the edge of the cylindrical part while the powder is supplied to the powder fluidization hopper from the powder feed hopper.

Therefore, it is preferred to be formed so that it may become especially 1.5 or more times so that the area of an immobilizing portion may become larger than the edge part area of the cylindrical part.

The continuous supply discharge method of the above-mentioned powder of this invention is applicable to the wide range pulverized coal represented by not only the toner for electro photography but medicine, and foodstuffs.

The continuous supply discharge method of the above-mentioned powder is effective in especially filling up a container with the powder after discharge, and the continuation powder filling method will be explained.

The powder outlet of a powder fluidization hopper is made open for free passage, and the measuring tank which possesses a filling amount control unit which is explained previously in the continuation powder filling method of this invention is used, the discharge quickly the powder fluidized within this powder fluidization hopper from a powder outlet, it is transported into this measuring tank, powder is discharged from this measuring tank and filling to the powder filling container is performed, the amount of powder discharged from this measuring tank is controllable by the filling amount control unit of this measuring tank.

By carrying out like this, it is a continuation powder filling method of this invention, the container can be filled up with the powder of given amount quickly and precisely the neither more nor less in the powder filling container. It shall carry out without spoiling many physical properties and combination nature of toner without it disgraces a working environment and a worker, and there being no danger and giving special stress further to the toner for electro photography.

The filling amount control unit becomes fundamental from the valve opening ratio control unit of this outlet provided in the powder outlet part of the measuring tank. What is used as this ratio-of-valve-opening control unit in this invention, the a member from which it intercalates in the powder outlet part, and can secede especially, and making intercalate from the member, being alike to that extent, responding, and regulating the degree of opening/closing of the powder outlet part for filling although there is no restriction. Or it comprises the member which passes the gas provided in the powder outlet near part, and does not pass powder, it, and an external gas suction unit open for free passage.

Air is discharged by this gas suction unit, powder is drawn, and the way of regulating the degree of opening/closing of the powder outlet part for filling according to the suction extent is used preferably. The term "measuring tank" in this invention as in the example shown in FIG. 7 means that in controlling measuring the powder filling container carried on the load cell of a weight managing unit, and interlocking regulation according the amount of powder with which it fills up to a filling amount control unit, and measuring by a weight managing unit, and carrying out, and is expressed.

The measuring tank in this invention can be applied also when not performing such ganged control. When an auxiliary container is arranged between a measuring tank and the powder filling container, powder is once accumulated in this funnel shape auxiliary container from a measuring tank and it is made to carry out spontaneous emission of the air between powder from the opening part of this auxiliary container, the necessity of doing anew the work which removes the air between powder decreases after falling in the powder filling container, it is effective in the time which needs powder to produce the powder filling container with which it filled up with high density being shortened, and raising filling speed.

In this case, although air is somewhat introduced in a powder filling container with powder from an auxiliary container, the gap is provided between the outlet part of this auxiliary container, and the opening of the powder filling container, and it may be made to make it emit from this gap about this air. Especially a funnel-shaped thing is preferably used as this auxiliary container. The ventilating pipe to which nothing and this funnel shape auxiliary container connect that byway oral region and circular bottom, or its near part is provided in the planate wall with which the opening where the circular bottom of this funnel shape auxiliary container intercalates the powder outlet of the measuring tank is provided is used, and it is between the measuring tank and the powder filling container.

This funnel shape auxiliary container is arranged and, subsequently to the powder filling container, the powder discharged from the measuring tank is dropped one by one in this auxiliary container.

Air which exists in the powder filling container with powder after falling, is circulated in this auxiliary container through this ventilating pipe, and it emits outside from the gap provided between the opening of this auxiliary container, and the cylindrical body part which has the powder outlet of a measuring tank.

The gap is provided between the outlet part of this funnel shape auxiliary container, and the opening of the powder filling container, and it may be made to make it emit to when the air remains from this gap in the powder filling container.

Since according to the way using the funnel shape auxiliary container with which the ventilating pipe is provided the necessity of doing anew the work which removes the air between powder decreases after falling in the powder filling container. It is effective in the time which needs powder to produce the powder filling container with which it filled up with high density being shortened, and raising filling speed.

Even if there are few powder layers in a powder fluidization hopper, a fluidization portion and an immobilizing portion are formed in the surface, the powder is supplied to the powder fluidization hopper continuously from the powder feed hopper and to enable the transfer of powder smoothly moreover at a measuring tank, it is important about especially a fluidization unit to devise the installed position of an air introductory part, the width of an air introductory part, or control of the air weight flow rate.

Air introduced without the air introductory part which constitutes this fluidization unit giving mechanical stress to powder, by forming a fluidization portion and an immobilizing portion in a powder layer as mentioned above, and adjusting the amount of air blowing in which is made to form in a powder layer slightly expansion thru/or the state where it is made to floating state, and is introduced into it by an introductory control valve.

The amount of discharge from the formation state and powder fluidization hopper of the fluidization portion and the immobilizing portion to a measuring tank can be adjusted. In order to form effectively the fluidization portion and immobilizing portion for supplying powder to the powder fluidization hopper continuously from the powder feed hopper although to install in the bottom of the powder fluidization hopper is not necessarily required about the air introductory part of the fluidization unit.

It is preferred to install in the powder outlet side from just under the immobilizing portion which to install in and the bottom is desirable, and is formed in the surface of a powder layer, and the width of this air introductory part has a still more preferred way which is not so large.

Therefore, although the shape in particular of a powder fluidization hopper may not be restrictive and a cylindrical body or a cube is sufficient as the inner wall side, be easy to move powder to the air introductory part, it has the recessed portion which provided inclination towards the bottom from the middle of the inner wall side, the air introductory part is provided in the recessed portion, and it is still more preferred that not the whole surface of a bottom but the air introductory part provides partially.

The powder to the measuring tank can be made to transport more smoothly by making it what turned the recessed portion of the bottom of the powder fluidization hopper to the powder outlet, and provided downward inclination. As for the bottom wall portion which has the recessed portion which provided inclination towards the bottom from the middle of such the inner wall side, it is preferred to be formed in one as one copy of the structure portion of a powder fluidization hopper.

As explained above, the composition of the powder fluidization hopper, without overflowing from the powder fluidization hopper, and stopping on the way, and the supply of powder is continuously enabled from a powder feed hopper to a powder fluidization hopper, the consolidation of the powder moreover deposited on the powder outlet of a powder fluidization hopper bottom is prevented, and the role which helps the discharge to a measuring tank is borne.

It is not necessary to necessarily unify the powder fluidization hopper and the measuring tank, and the powder discharged from the powder fluidization hopper moves to a measuring tank preferably through the connecting tube which is a powder connection way between a powder fluidization hopper and a measuring tank.

The amount of gas blowing in from this 2nd powder fluidization unit is adjusted by providing the 2nd powder fluidization unit in this connecting tube, the discharge stop can be carried out by preventing grain bridge formation within a connecting tube, and adjusting the amount of discharge of the powder discharged through a connecting tube to a measuring tank, or stopping gas blowing in.

Although it is not necessarily indispensable in this invention, a pressure control unit may be provided in at least one of the powder fluidization hopper and the measuring tank, and the pressure control unit controls the internal pressure thereof.

In the continuation filling method and its filling system of this invention, it is preferred to use the filling powder weight managing unit for managing the amount of filling powder to the powder filling container, and such filling toner weight managing unit. For example, it can be considered as the thing with a monitor which displays the weight value which can be a load cell of the common use for measuring the weight of the part laid upwards, and is measured.

Measurement of the powder weight by a load cell although it is not indispensable requirements in this invention, it may be constituted so that the filling amount control unit may be interlocked and it may control.

It may be constituted so that the amount of gas blowing in from the powder fluidization unit may be adjusted, and the timing for nothing and such signal dispatch can be made to calculate further, so that the control signal for it and a control signal may be sent from a central processing unit. The input unit which shall set up necessary the filling amount beforehand, and shall change such a central processing unit, and can input the invitation and change invitation for it should be attached.

The fluidization portion and the immobilizing portion are formed in the surface portion of the powder layer in this powder fluidization hopper of this invention, and the cylindrical part of this powder feed hopper is inserted in the surface immobilizing portion, there is no way of supplying the powder in a powder feed hopper to a powder fluidization hopper continuously in the former in itself, and it can be applied broadly.

Therefore, after supplying powder in this powder fluidization hopper, the transfer place of the powder discharged from this powder fluidization hopper is not limited to the measuring tank.

Next, the third preferred embodiment of the invention will be described in detail using the accompanying drawings.

Figure 7:
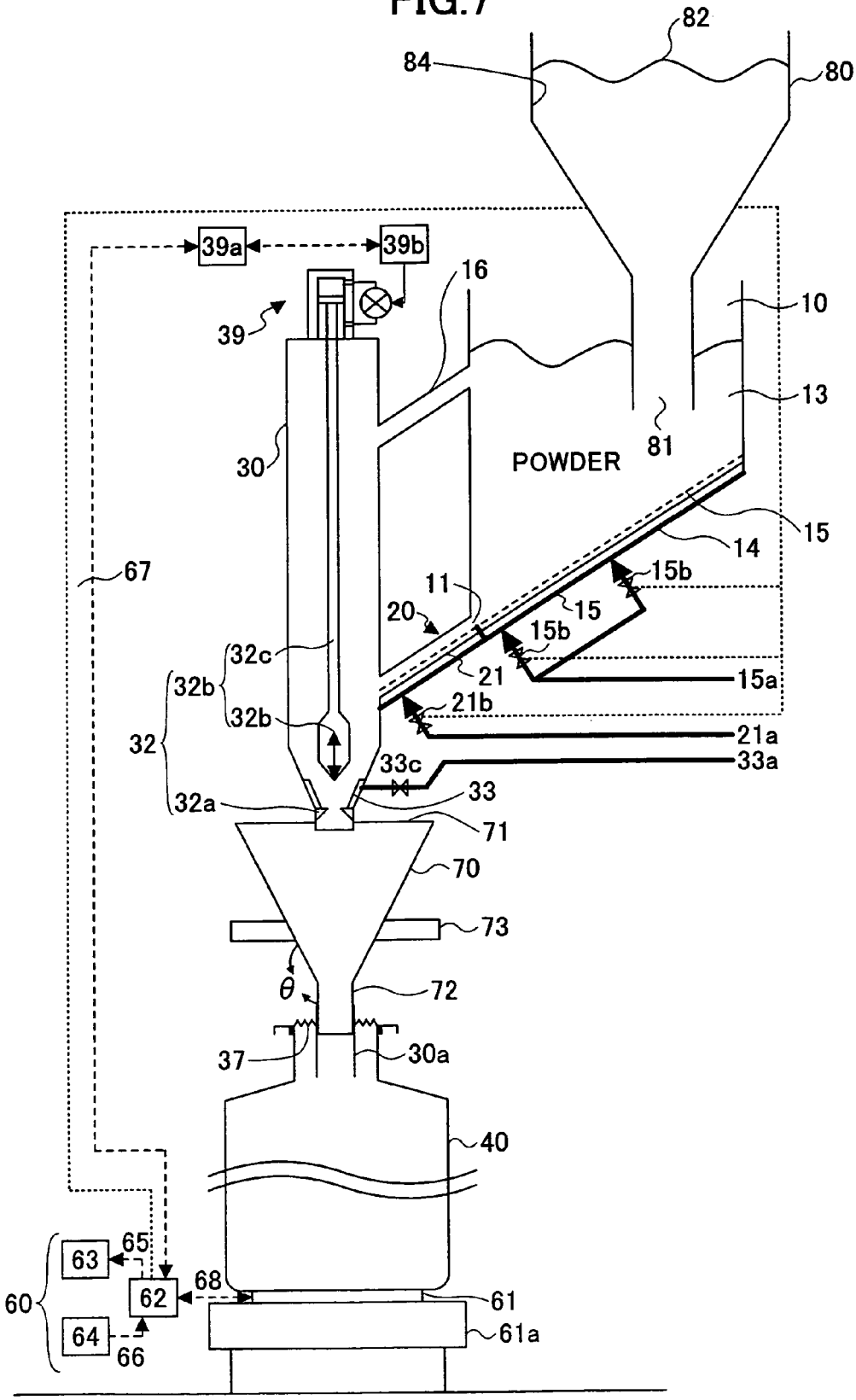
FIG. 7 is a cross-sectional view showing an example of a powder filling system of the present invention which uses a powder feed hopper.

FIG. 7 shows an example of the filling system applied to the continuation powder filling method of the invention.

The powder feed hopper (80) which collects powder in the powder filling system shown in FIG. 7, is connected with the powder fluidization hopper (10) this powder fluidization hopper (10) and connecting tube (20) with which the powder is supplied.

The funnel shape auxiliary container arranged under the powder outlet of the measuring tank (30) which introduces the powder from a powder fluidization hopper (10), and this measuring tank (30), and the powder filling container (40) carried on the powder weight managing unit (60) are installed.

The fluidization unit (15) provided in a powder fluidization hopper (10) after the powder in a powder feed hopper (80) is supplied to a powder fluidization hopper (10), the powder which is in the fluidized state is transported into the measuring tank (30), and is transported by controlling the amount of discharge by the filling amount control unit (32) provided in the near part of the powder outlet (31) of this measuring tank (30), and the powder weight managing unit (60).

It is made to fall in the powder filling container (40), and the powder filling container (40) with which it filled up with the powder of the given amount is produced. The opening (82) for supplying powder from an outside as a powder feed hopper (80), if it has the cylindrical part (81) used as the outlet where the discharging occurs in the powder fluidization hopper (10), the quality of the material, and size in particular are not restrictive, but it is a funnel-shaped product made from stainless steel.

In the diameter of the outlet of 500-1000 mm and a cylindrical part (81), the length of a cylindrical part (81) at 300-600 mm About 400-600 mm, the diameter of the opening (82) at about 45-65 degrees, the capacity of the angle (theta) of a funnel-shaped conical wall part (84) and the cylindrical part (81) is also in the range of 150-350 l.

The powder fluidization hopper (10) has the powder fluidization unit and the powder outlet. In the powder fluidization unit, when the fluidization portion and the immobilizing portion are formed in the surface part of the powder layer and the cylindrical part (81) of this powder fluidization hopper (10) is inserted in the immobilizing portion. If only it enables supply of the powder in a powder feed hopper (80) in a powder fluidization hopper (10) continuously, the quality of the material, and size in particular are not limited, but the shape of a cylinder type or cube shape is sufficient as a wall part (13), the product made of a plastic can also use the product made from stainless steel, and that whose capacity is in the range of 35 to 55 l is used preferably.

Figure 8:
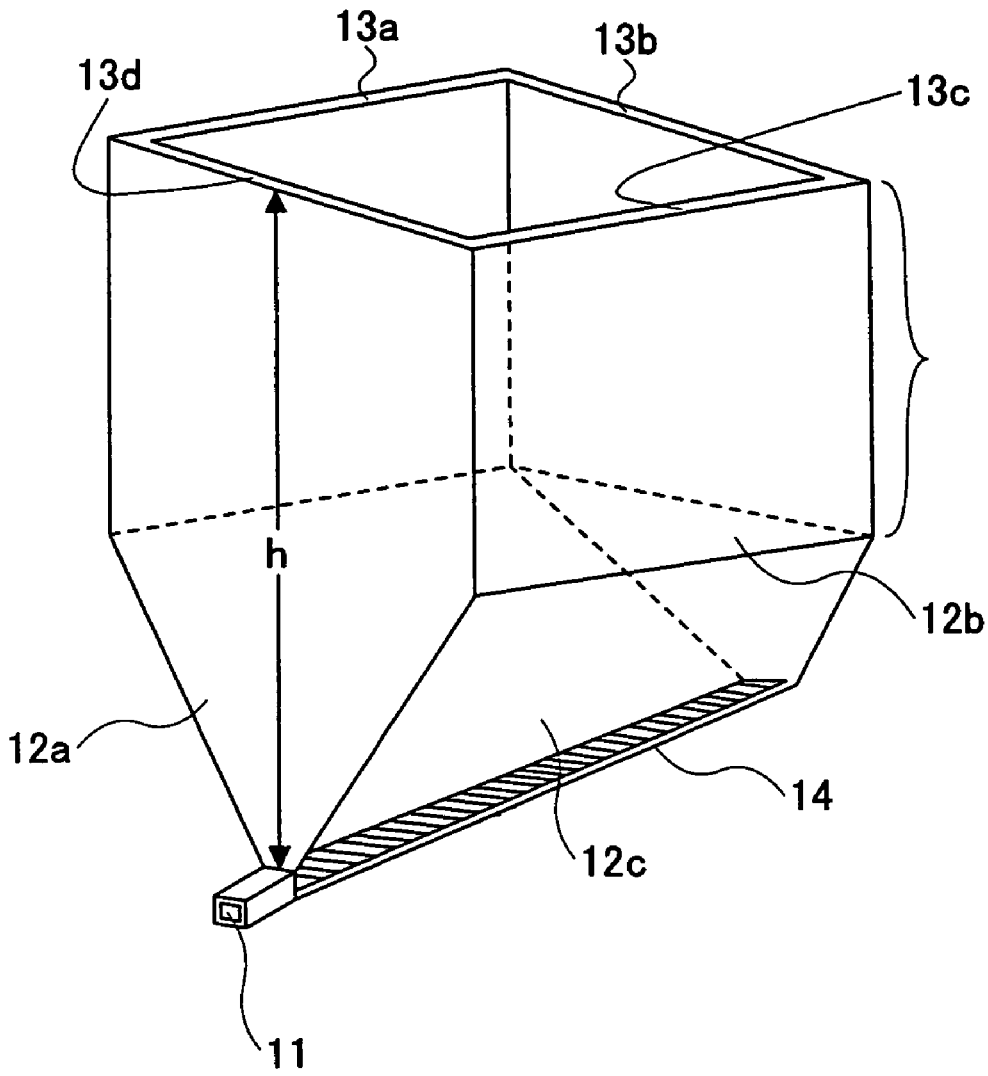
FIG. 8 is a perspective view showing an example of a powder fluidization hopper in the powder filling system of the present invention.

FIG. 8 shows an example of the powder fluidization hopper. As shown in FIG. 8, the powder fluidization hopper (10) includes the wall parts (13*a*) and (13*b*) and the cube shape parts (13*c*) and (13*d*). The wall parts (13*a*), (13*b*) and (13*c*) are the inclined inside wall portions (12*a*), (12*c*) and (12*b*) which are similarly stands in a row. It comprises the bottom (14) which includes these inclined inside wall portions and the groove portion formed in the wall part (13*d*).

The powder outlet (11) is provided in the end part of the bottom (14), and a bottom (14) carries out a downward inclination toward a powder outlet, and the fluid bed is provided in this bottom (14) as a gas introductory part which constitutes a powder fluidization unit. The bottom (14) which powder gathers for a bottom (14), and becomes easy to fluidize, and carried out the downward inclination towards the powder outlet by providing the inclined inside wall portion makes fluidized powder easy to discharge smoothly.

As for the angle of gradient of the inside wall portion, it is preferred that it is in the range of 30-60 degrees, and, as for the angle of gradient of the bottom towards a powder outlet, it is preferred that it is the range of 30-60 degrees.

In FIG. 7, the fluid bed (not illustrated) is provided in the bottom (14) of the powder fluidization hopper (10), and the powder fluidization unit (15) is constituted from this fluid bed and the gas introducing pipe (15*a*) which stands in a row in it. A gas is sent into the fluid bed through the gas introducing pipe (15*a*), and powder is made to fluidize from the gas introducing unit (not illustrated) provided outside.

As for introduction of this gas, it is preferred that the air pressure is in the range of 0.1 to 0.5 Mpa, and the air flow rate is in the range of 750 to 1500 ml/200 cm2×1 min [air amount per unit time by unit fluid bed area]. As for the pressurized gas which this fluid bed has much fine holes for spouting a gas, and each fine hole comprises a porous body which is mutually open for free passage inside, and is introduced into this porous body from a gas introducing pipe (15*a*), it is preferred to adjust by the flow control valve (15*b*).

As this porous body, metal mesh material, such as a sintering object (metal, product made of resin) with the smooth surface or twill weave, etc. is used preferably. Although the number of these fluid beds where it comes to use a porous body is not limited, it is preferred to divide and install in 1-5 places preferably, and it is preferred that the sizes of this fluid bed are 5-15 mm in width and 60-130 mm in length.

It is preferred to provide all over the bottom of a powder fluidization hopper, when there are many two or more fluid beds, and to bring near and provide in the powder outlet side, when there are few numbers. Also when providing two or more fluid beds, the way which introduced the gas only from the fluid bed of the powder outlet side slippage if possible forms in the powder layer surface the non-flowability portion which intercalates a cylindrical part like this invention.

When providing a few fluid beds effectively, it is preferred to provide in the place near just under the non-flowability portion the powder outlet side where a cylindrical part is inserted. The size of the powder clouds (powder suspended matter of the shape of a cloud formed of mixing with powder and a gas) formed of mixing with the delivered gas can be adjusted.

Although not illustrated, in order to prevent the dust explosion of the fluidized powder, in the powder filling system of this example, the discharge unit for discharging the generated static electricity is provided.

The measuring tank (30) connected with the powder outlet and connecting tube (20) of this powder fluidization hopper (10) possesses the powder filling system of the example of FIG. 7.

The fluidization unit (21) can be provided in this connecting tube (20), it lets a gas introducing pipe (21*a*) pass to it, and a gas is an introductory control valve (21*b*). It is introduced being adjusted and is made to introduce smoothly by maintaining the flow state of the powder introduced from this powder fluidization hopper (10) to the measuring tank (30).

Next, the measuring tank will be explained.

The material of the measuring tank is not restrictive, and the measuring tank may be made of a metal, such as stainless steel, titanium, and aluminium, or a product made of plastics is also applicable. That is, from the filling amount control unit installation site to a powder discharge port, the whole comprises tubular structure (it is called a tubular body), and especially the thing of a cylinder type is used preferably.

It is preferred that the path uses what is about 50-200 mm, and it is preferred that the path of the powder discharge port of a measuring tank (30) uses what is about 5-15 mm. It is needless to say that a powder discharge port and the opposite side are closed.

The filling amount control unit (32) in the measuring tank of FIG. 7 will be explained.

That is, the filling amount control unit (32) in the device of this example comprises the elastic body ring (32*a*) which has the discharge opening (31), and the discharge control unit (32*b*) which controls the discharge of the powder from the discharge opening (31). This discharge control unit (32*b*) comprises the discharge control member (32*d*) with which the discharge control pipe (32*c*) which moves up and down the inside of the measuring tank (30) is equipped, and the discharge control member (32*d*) is a member of the conical shape which intercalates—breaks away with a powder discharge port (31), and opens and closes this discharge opening (31).

The degree of opening/closing of a powder discharge port (31) is adjusted by the insertion degree to the powder discharge port (31) of the elastic body ring (32*a*) of the discharge control member (32*d*) of conical shape depending on the degree of the up/down movement and the degree of fitting of the discharge control pipe (32*c*) within the measuring tank (30).

The conical edge of the small radius of a discharge control member (32*d*) escapes from a powder discharge port (31) completely, and it is until last when it moves up, it is in a full open state (free discharge of the powder with which it fills up), and the discharge control members (32*d*) when it descended and intercalates so that it may fit into a powder discharge port (31) completely to the conical origin end of a path, it is in all the closed states (discharge stop of powder).

It is in the state which it has not fallen out completely from this powder discharge port (31), the intermediate state (32*d*), i.e., discharge control member, and has not descended completely, and is between the conical radius part of the size of the degree of middle of a discharge control member (32*d*), and this powder discharge port (31).

When it intercalates in the degree by which a gap is held, it is in the half-opening state (partial discharge of powder) according to the insertion level.

Although the cover member (37) is provided in the sleeve (30*a*) under a powder discharge port (31), the cover member (37) can also be omitted in this invention. The direction of the inside which cannot but contact when thickness is carrying out the section wedge shape which became thin, therefore full insertion of the discharge control member (32*d*) is carried out as are shown in FIG. 7, and an elastic body ring (32*a*) moves to an internal powder discharge port (31) from a periphery has large plasticity.

When it is considered as the elastic body ring (32*a*) of such a structure, even if it contacts a discharge control member (32*d*), produce filming of powder on neither an elastic body ring (32*a*) nor the discharge control member (32*d*) surface. It is considered for hardly giving stress to the powder which remains unescapable among both, even if an elastic body ring (32*a*) contacts a discharge control member (32*d*).

According to the invention, it is as the filling amount control unit of the discharge opening (31) of the measuring tank (30), with elastic body material, form a powder discharge port (31) in proper shape, and the valve opening ratio regulation member can be considered as what can adjust an opening degree according to the relative location relation of the double door mouth by movement of the member which has the opening which could consider it as the tabular member which adjoins this discharge opening, and moves and prescribed-distance-slides to a plane direction, and agreed in the discharge opening.

And the up/down movement of such a discharge control pipe (32*c*) is performed by the driving device (39) driven by the source of a drive (39*b*) controlled by drive control equipment (39*a*). Although the driving device (39) for rise and fall of a discharge control pipe (32*c*) can perform suitably an air pressure cylinder, a motor, an oil pressure cylinder, etc. by a unit, the air pressure cylinder is used for it in the device of this example.

Figure 9:
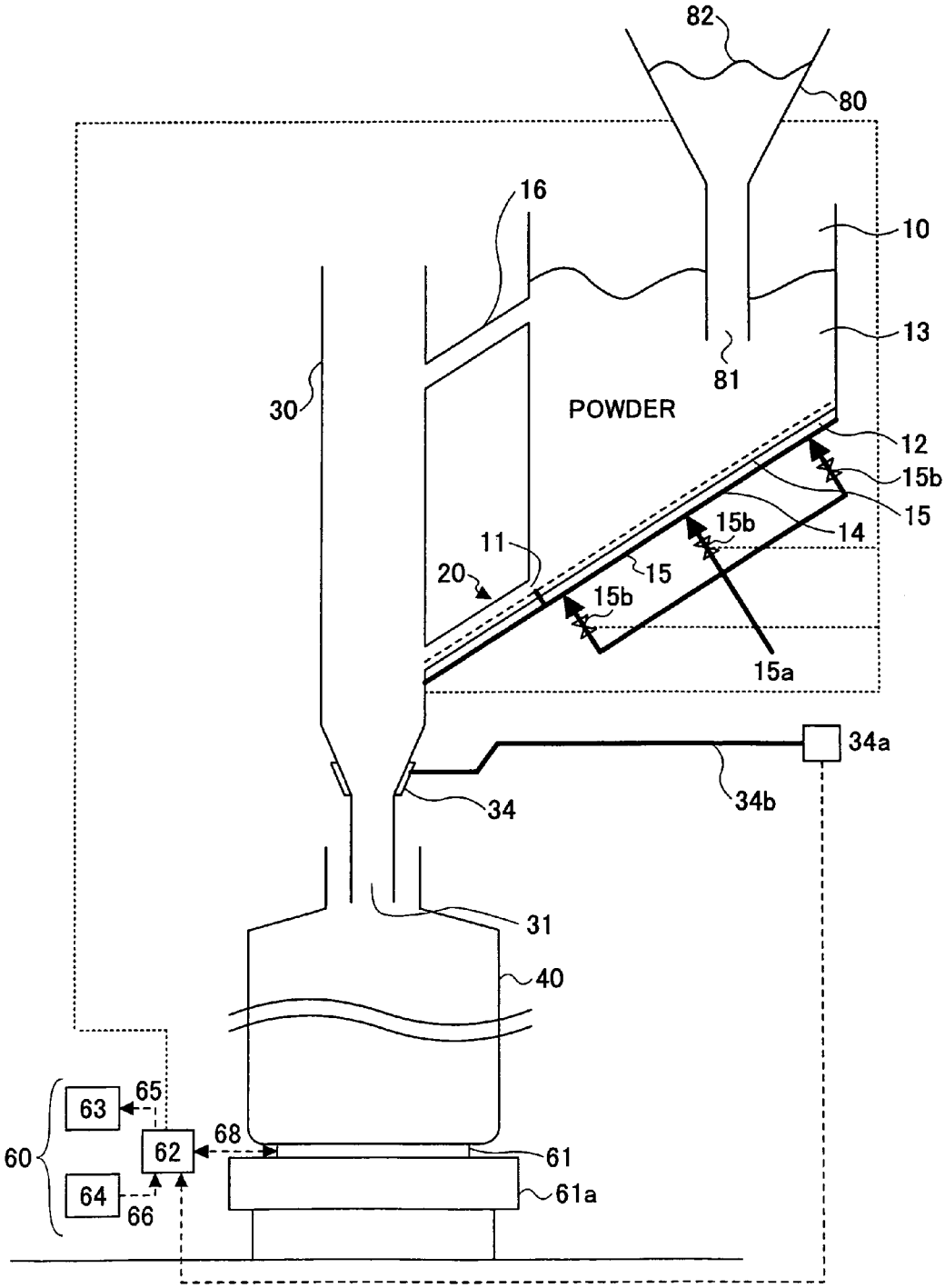
FIG. 9 is a cross-sectional view showing another example of the powder filling system of the present invention which uses the powder feed hopper.

FIG. 9 shows an example of the powder filling system used for this invention in which the powder feed hopper (80) is included. The powder filling container (40) carried on the load cell (61) of the powder fluidization hopper (10) with which the powder is supplied, a measuring tank (30), and a powder weight managing unit (60) is installed.

In this example, it is also possible to install a funnel shape auxiliary container between a measuring tank (30) and the powder filling container (40). The filling amount control unit (34) is provided near the powder discharge port (31) of the measuring tank (30), and the filter material which passes a gas passes but does not pass the powder is used.

It is effective, if the upper part serves as diameter reduction structure from the part which has been the cylinder body and the measuring tank (30) provides the installation site of this filling amount control unit (34) near the termination part whose diameter is reduced towards the powder discharge port (31) from the termination part of diameter reduction in the case of the structure which is a cylinder body.

If the gas suction unit (34*a*) which is connected with the filling amount control unit (34) and which is provided in the exterior of the measuring tank (30) is worked, at the same time the gas which exists between the powder in the measuring tank (30) is attracted and a gas is discharged through the gas suction pipe (34*b*) with which this mesh part and the gas suction unit are connected. The toner powder attracted by the surface of a wall of this mesh part extracts, it will be in a state, and a powder group is formed, by adjusting suction pressure, the powder size of subgroup is changed and, as a result, the filling amount is adjusted.

The plurality of through holes are provided in the tubular body itself beforehand, and this filling amount control unit includes the filter material, and the through hole is closed by the wall that it is fixed like, and a space part is formed in the outside of this charge of filter material fixed part, and there is no gas leakage is provided.

The filter material can become what is supported by the tubular body, and hardness can raise this through hole. On the other hand, the gas exhausting port is provided in this wall, and it is made to open this gas exhausting port for free passage with the gas suction unit.

The kind of the material which the quality of the material which constitutes this wall is not restrictive, and the same material is used for the measuring tank.

If only this wall will be in the state where the gas attracted through the filter material does not leak, it can be formed even in the perimeter enclosure also around the tubular body. The function of the filling amount control unit in the order near the powder discharge port is divided at two portions into the discharge stop function part and the discharge amount regulating-function part.

Since it can be filled up with the predetermined amount of powder in the powder filling container correctly and quickly, without what adjustment of the gas suction pressure by a suction unit can carry out smoothly, and suction pressure is too strong and is got blocked happening if it provides.

FIG. 3A shows the filling amount control unit setting part, and shows the case where the filling amount control unit is not divided into two portions of a discharge stop function part and the amount regulating-function part of discharge.

The through hole (50) is provided near the powder discharge port (31) of the measuring tank (30), and the through hole (50) is closed by the filter material (51) being fixed, and the wall (52) which does not have gas leakage in the outside of the filter material (51) further is provided so that a space part (53) may be formed.

On the other hand, FIG. 3B shows the case where the filling amount control unit is divided into two portions of the discharge amount regulating-function part (A) and the discharge stop function part (B), the through hole (50), the filter material (51), the wall (52), and the space part (53) which are provided therein.

If only this wall (52) will be in the state where the gas attracted through the filter material (51) does not leak, it can be formed even in the perimeter enclosure also around the tubular body. As for the filling amount control unit, it is effective to form it at the 5-50-mm-wide charge of a filter material, as 60%-100% of the portion of the circumference of the tubular structural part is rolled.

The filter material formed in a twill weave is preferred as the filter material which has a function which air passes and a toner powder does not pass. And a filter material formed in a twill weave with mesh 500/3500 is still more preferred.

What comprised a fine charge of a filter material of a mesh is effective as what is used especially for a filling amount control unit as it is preferred to use what comprised a layered product of the filter material of two or more sheets from which a mesh differs and it is on the inner core part side of a tubular body as this layered product.

Especially as a gas suction unit which makes connect with this filling amount control unit, and is used, although not limited, a vacuum pump suction type, an ejector mechanism suction type, etc. are used, for example, and it is desirable at the point that an ejector mechanism suction type hardly needs maintenance.

Although not limited for the suction pressure obtained by this gas suction unit, if it draws in the range of −5 to −50 kPa, the filling amount is effectively controllable. Regulation of this suction pressure can also be carried out by providing the control valve (not illustrated).

Although the powder from a measuring tank to a powder filling container can adjust the internal pressure and delivery velocity of a filling amount control unit part in a measuring tank and it can be stopped, it is preferred that the bulk density of the powder in that case is in the range of 0.4 to 0.5.

As the filling amount control unit used for the filling system of this invention, mechanical stress will not start powder if these filling amount control unit illustrated especially are used. Desorption of the additive (external additive) made to adhere to the surface in order to increase especially the flowability of toner etc. does not take place easily.

It is difficult to generate the cohesion also in the case of the toner for low-temperature fixing which made low melting point resin contain, not to reduce the characteristics of toner to it, and to adhere to a discharge opening, not to bar discharge to a container, and to raise filling work efficiency.

In the filling system of this invention, the pressure control unit may be provided in the measuring tank (30) to control the internal pressure thereof. Alternatively, this pressure control unit may be instead provided in the powder fluidization hopper (10), or it may be attached to the powder fluidization hopper (10).

Such a pressure control unit enables regulation of the pressure state in the powder fluidization hopper in the state where the gas is sent from the above-mentioned powder fluidization unit (10), and/or the measuring tank (30), or a powder cloud state.

Next, the auxiliary container (70) like the powder filling system shown in FIG. 7 which can be installed between a measuring tank (30) and the powder filling container (40) will be explained.

As this auxiliary container (70), using the conical funnel-like member is preferred, and that in which the gas permutation unit (74) is provided is used. The opening (71*a*) is provided in the conical bottom (71) of this auxiliary container (70). The cylinder part (72) which is installed just under this measuring tank (30) so that the powder breathed out may be received, and has the outlet (72*a*) of the auxiliary container (70) is made to intercalate in this opening of the powder filling container (40), and this auxiliary container and a powder filling container are installed.

If each part size of this funnel-like auxiliary container is not restrictive, an about 130-180 mm container is used of the diameter of the conical bottom and the angle (theta) of the conical top is in the range of 50-70 degrees.

It is desirable although dropping ejection from this auxiliary container to a powder filling container is performed smoothly. Although there is no restriction in the quality of the material of this auxiliary container, the thing made of resin is preferred in respect of workability, for example, since visual recognition of the discharge state of internal powder is attained with polyester, polycarbonate, or acrylic system resin being used, and it is translucency.

The tubular body part edge of the funnel-like auxiliary container is made of a cushion-like sponge if it fixes by sticking the nozzle (packing) which comprises the quality of the material and an outlet is formed. If the opening of the powder filling container installs an auxiliary container and the powder filling container as it hits this nozzle, since an impact can be eased.

If the auxiliary container is moved up or down by using the powder filling device having the rising/falling unit for moving up and down the auxiliary container, exchange of the powder filling container can be made easy. In order to exchange after filling up the powder of a given amount in the powder filling container (40) with another powder filling container, it is possible to move up and down this auxiliary container (70) by the rising/falling unit (73).

The gas carried out between the powder which this auxiliary container (70) shown in FIG. 7 falls from the measuring tank as mentioned above, and is once accumulated in this auxiliary container, i.e., in order to carry out spontaneous emission of the air mainly from the opening of the conical bottom (71).

Although it is installed and powder is dropped in the powder filling container (40) after that, when air exists in the container for after-fall powder filling (40), it is made to emit from this cylinder opening (72) of this auxiliary container (70), and the gap between the containers for powder filling (40), the deaeration pipe is further inserted into the powder in the powder filling container (40), and it is also possible to carry out suction discharge.

As the auxiliary container (70) used for the powder filling system of this invention, the gas permutation unit is applicable. Although that example is explained based on FIG. 5, as the auxiliary container (70) with which the gas permutation unit (74) is provided, it is not limited to this example. The powder discharge port (31) at the edge of the measuring tank (30) is inserted in the opening (71*a*) of the conical bottom (71) of the auxiliary container (70). The cylinder part (72) which is installed and has the outlet (72*a*) of this auxiliary container (70) is installed so that it may intercalate in the opening (41) of a powder filling container (40).

The gas permutation unit (74) is provided in the auxiliary container (70) integrally. This gas permutation unit (74) comprises the ventilating pipe (74*a*), the vent (74*b*) is formed in the circumference of the outlet (72*a*) of the auxiliary container (70), and the vent (74*c*) of another side is formed in the upper part of the conical bottom (75) of the auxiliary container (70), respectively.

It is mostly made a plane and the shape of the ventilating pipe part (74*d*) of the part neighborhood which changes to a cylinder part (72) from the conical wall part (75) of this auxiliary container (70) is stuck on parallel and the nozzle (76) which becomes the circumference of the plane portion from cushioning-properties material by the conical bottom (71).

When this nozzle (76) is installed in the powder filling container, it has a function which softens the impact by the opening (41) of that powder filling container (40), and builds the sealed state of an auxiliary container and a powder container. Subsequently to the powder filling container, the powder discharged from the measuring tank falls one by one in this funnel shape auxiliary container with which this gas permutation unit is provided, and the powder filling is performed.

Air which exists in the powder filling container with powder after falling from this funnel shape auxiliary container, is circulated in this auxiliary container through this ventilating pipe, and it emits outside from the gap provided between the opening of this auxiliary container, and the cylindrical body part which has the powder outlet of the measuring tank.

When air remains in the powder filling container, the gap is provided between the outlet part of this funnel shape auxiliary container, and the opening of the powder filling container, and it may be made to make it emit from this gap.

Since according to the way using the funnel shape auxiliary container with which the ventilating pipe is provided the necessity of doing anew the work which removes the air between powder decreases after falling in the powder filling container.

It is effective in the time which needs powder to produce the powder filling container with which it filled up with high density being shortened, and raising filling speed.

In the filling system of this invention, a pressure control unit (not illustrated) may be provided in the measuring tank (30) to control the internal pressure thereof. Alternatively, this pressure control unit may be instead provided in the powder fluidization hopper (10), or it may be attached to the powder fluidization hopper (10).

Such a pressure control unit is used to regulation of the powder fluidization hopper (10) in the state where the gas is sent from the powder fluidization unit (15) and/or the pressure state in a measuring tank (30), and a toner cloud state.

On the other hand, as for the filling powder weight managing unit in the powder filling system of this invention, it is preferred to have the filling powder weight managing unit for managing the amount of filling powder to the powder filling container (40), and the system of this example (60), the powder filling container (40) is laid on it. It has the load cell (61) for measuring filling toner weight. The load cell (61) is provided on the lifter (61*a*) for moving up and down this and changing suitably the gap of a measuring tank (30) and the powder filling container (40).

The monitor unit (63) for displaying the measured filling powder weight on the load cell (61) is provided. It is based on the voltage signal from a pressure-receiving detection unit which detects the voltage which changed according to the degree which receives and carries out the elastic deformation of weight or the pressure as such a monitor unit, or based on the development signal from the pressure detection element, such as a piezoelectric element, into which an electromotive force is directly converted according to the received pressure, the known indication unit which can display measurement weight can be used, the weight displayed on the monitor unit (63) is seen, and it is with an identification about the filling amount of toner. Thus, the powder filling can be performed or completed.

Moreover, the filling powder weight managing unit (60) can be used in the powder filling device of this invention, and, in that case, the empty weight of the powder filling container (40) and the gross weight of the powder filling container (40) filled up with the powder can be measured, and the computation processing unit (62) computes a filled-up powder weight.

And the computation processing unit (62) has an input unit (64), and referring to the weight displayed, for example on the monitor unit (63) by this input unit (64), the input of the initial filling weight of powder is performed and it can make an inputted change of initial filling weight.

The processing unit (62) is based on the operation result, and is the drive command signal from the communication line (67) to the drive control equipment (39*a*) of the source (39*b*) by the drive of the driving device (39). The drive control equipment (39*a*) makes it go up and down the discharge control pipe (32*c*) of the filling amount control unit based on it, and adjusts the degree of opening/closing of the delivery of the measuring tank.

When the filling amount control unit of a measuring tank uses what comprises the member which passes the gas provided in the powder discharge port near part of the measuring tank, and does not pass powder, it, and an external gas suction unit open for free passage, based on a drive command signal, the gas suction degree by this gas suction unit can be adjusted similarly.

It is to various CPUs which contain a thing like a microcomputer chip from an easy analog type voltage comparator as this processing unit (62). Various control units can be used (in the case of the analog type voltage comparator, the AD converter according to predetermined electric potential difference changed into a pulse signal is attached).

Although the input unit (64) in this example is the button/rotation knob of the digital switch as a code generator (binary code), when providing the computation processing unit (62) to the CPU, it can be considered as a keyboard and, of course, is stored in that case possible rewriting (based on the result of operation, and/or the result of the incoming signal from an input unit) of the various data containing weight (namely, called to CPU one by one operation). The ROM storing various programs including the processing program for carrying out operation processing of the RAM which stores this operation result one by one again, and this various data, and various invitation information dispatch programs enabling a free call can be attached.

And the computation processing unit (62) can be constituted based on the operation result in what has a program which transmits the opening/closing command signal of each of the flow control valves.

In the powder filling system of this invention, two or more connecting tubes which connect a powder fluidization hopper (10) and a measuring tank (30) are provided. From the position where powder fluidization hoppers differed, (for example, connecting tube (16) in FIG. 3) and the opening of each connecting tube can transport powder to a filling cylinder. One of the connecting tube of the can use the pressure of the upper space of a measuring tank (30) as the pressure regulation member maintained below to an atmospheric pressure.

As for the degree (the size of the toner clouds) of expansion of the powder layer in a measuring tank, it is preferred to adjust the degree to be in the range of 25%-600% of the depth of the powder layer.

As the unit which raises the bulk density of the fluidized powder layer, the air slide block of a porosity plate is divided and supply air is sent intermittently, and it can be made the shape of a pulse which divided powder, and can also convey.

Although the continuation powder filling method and filling system of this invention can apply various powder, it is effective for the toner for electro photographic printing method, and the kind is not restrictive. For example, a 2-component nonmagnetic black toner, a 1-component nonmagnetic color toner, a 1-component nonmagnetic black toner, or a 1-component magnetic black toner may be used.

Next, the example using the toner for electro photographic printing method will be explained concerning the powder filling system shown in FIG. 7 to which the continuation powder filling method of this embodiment is applied and the auxiliary container having the gas permutation unit is used as the auxiliary container (70).

First, the specification of each element used along with each component of the powder filling system will be explained.

The Powder Feed Hopper:

The funnel-shaped product made of stainless steel, capacity:

250, diameter of the opening: 700 mm, diameter of the outlet of the cylindrical part: 140 mm, length of the cylindrical part: 450 mm, the angle (theta) of the funnel-shape conical wall part and the cylindrical part: 60 degrees.

The Toner Used:

2-component nonmagnetic black toner (external additive adhesion toner) (Type 8000 toner for the Ricoh color laser printers), average volume particle size: 7.0 micrometer, true specific-gravity: 1.2.

3. Powder Fluidization Hopper

Shape and material: the product made of stainless steel shown in FIG. 4,

Capacity and size: Capacity: 45, Width (side walls 13*a* and 13*b*): 470 mm, Depth (side walls 13*c* and 13*d*): 400 mm, Device height (h): 750 mm, Cube part height (k): 360 mm, The fluid bed provided in the bottom (14): The fluid bed using a sintering resin porous material is installed at five places.

Sintering resin porous material: porosity polyethylene, 10 mm (width)×5 mm (thickness)×100 mm (length), average hole diameter: 10 micrometers, porosity: 30%.

4. Measuring Tank

The cylindrical body made of stainless steel which has a powder discharge port, the diameter in the middle of the cylindrical body is enlarged becoming a broad portion.

The whole length: 400 mm, Diameter of the powder discharge port: 10 mm, Length of the enlarged part from the powder discharge port: 80 mm, Angle of the enlarged part angle: 70 degree, Installed position of the filling amount control unit from the powder discharge port: 50 mm.

Figure 6:
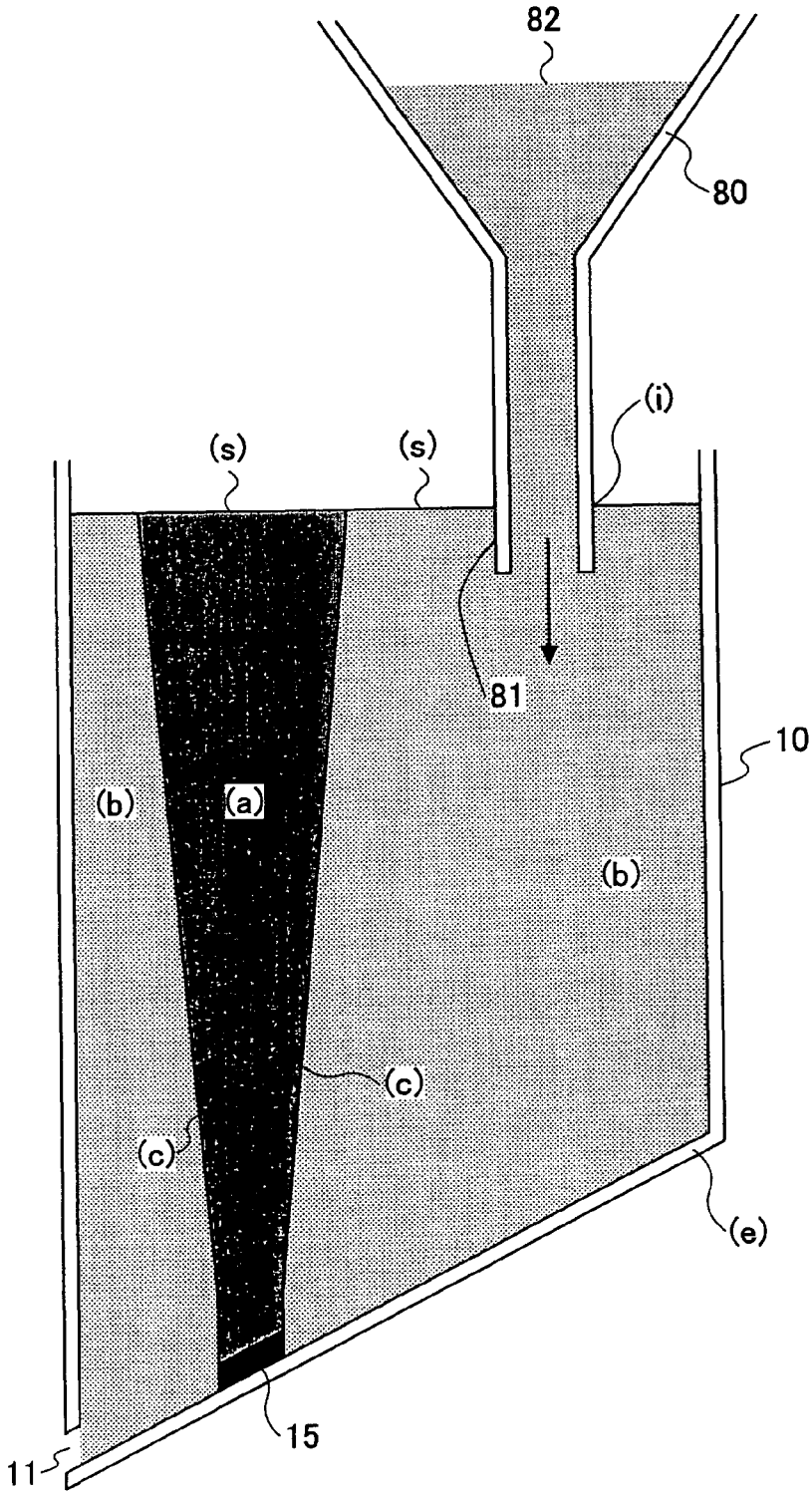
FIG. 6 is a diagram for explaining the powder supply mechanism in the powder filling device of the present invention.

The filling amount control unit (the element (b) in FIG. 6):

The unit provided with the discharge amount regulating-function part (A) and the discharge stop function part (B), The discharge amount regulating-function part (A) and the discharge stop function part (B) wherein four through holes are provided on each circumference of the respective cylinder bodies at equal intervals, and a 10-mm-wide stainless steel mesh (twill weave, mesh 500/3500) is wound around the circumference of the part (B) and a 30-mm-wide stainless steel mesh (twill weave, mesh 500/3500) is wound around the circumference of the part (A).

The wall made of a stainless steel wherein a space part in the circumference of the outside of each filter material and does not have gas leakage, and the gas exhausting port is further formed in this wall.

The gas suction unit formed using two ME-60 (the product from Koganei Co.), and each gas exhausting port is connected to one gas suction unit.

5. Auxiliary Container

The funnel-shape container made of polyester.

The nozzle made of sponge is stuck on the outlet, and as shown in FIG. 7 the gas ventilating pipe is penetrated from near the outlet part of the tubular body part to the wall upper part of the funnel as the gas permutation unit, and formed integrally.

Diameter of the cone bottom: 165 mm, full length: 280 mm, Diameter of the tubular body part where the outlet is provided: 11 mm, the angle of the conical top: 60 degrees.

6. Powder Filling Container

Diameter: 100 mm, length: 200 mm, volume: 1560 cc, cylinder type container made of polyester with the opening of the diameter of 20 mm.

The process in which about 8 t of toner is processed continuously using the powder filling system comprising the above-mentioned components according to the continuation powder filling method of the invention will be explained.

The powder filling system which is installed beforehand with the above-mentioned components as shown in FIG. 7 is prepared.

The auxiliary container is set up and fixed to a given position by the auxiliary container rising/falling unit so that the center of the conical bottom of the auxiliary container matches with the powder discharge port of the measuring tank.

Using the load cell as the weight managing unit, the empty powder filling container (40) in which powder is not contained is placed on the load cell (61), and the weight is measured. After this, the lifter (61*a*) is operated to raise the opening of the powder filling container to the position of the nozzle (76) near the outlet (72*a*) of the auxiliary container, and it is fixed.

First, the toner accumulated in the powder feed hopper to about 70% of the capacity is made to fall into the powder fluidization hopper with the powder outlet of the powder fluidization hopper being in the closed state, so that the toner is accumulated to about 80% of the capacity.

Next, air is introduced from the four fluid beds on the side of the powder outlet among the five fluid beds of the powder fluidization hopper into the inside at the air pressure of about 0.3 MPa(s) for about 5 minutes under the constant speed condition (under the conditions of the air flow rate which is balanced where the powder layer surface of the toner stays, which is 900 ml/200 cm2 by 1 min [air amount per unit time by unit fluid bed area]), so that the fluidization portion and the immobilizing portion are formed in the powder layer surface in the powder fluidization hopper.

After inserting the cylindrical part of the powder feed hopper in the immobilizing portion of this powder layer surface about 15 cm, the powder outlet of the powder fluidization hopper is opened and the discharging of the powder in the powder fluidization hopper into the measuring tank is started. Even after the start, the introduction of air is continued on the same conditions until the filling process of 8t of the toner is completed.

The toner introduced in the measuring tank (30) is dropped to the funnel-like auxiliary container from the powder discharge port (31) of the measuring tank, and it is made to fall in the powder filling container (40) from this auxiliary container further, and the filling work of the toner to one container is completed.

In this case, the toner is initially made to fall at the flow rate of 55 g/sec, and when the toner in this container becomes 90% of the given amount, the suction unit connected with the discharge amount regulating-function part (A) in the filling amount control unit of the measuring tank is worked by −15 kPa, so that the flow rate condition is reduced to 5 g/sec at that time.

If the toner filling work to one filling container is completed, the suction unit connected with the discharge stop function part (B) in the filling amount control unit of the measuring tank is worked to stop the falling of the toner. And the following powder filling container is set to the auxiliary container, and the operation of the suction unit connected with the discharge stop function part (B) is stopped to start the falling of the toner. The repetitive toner filling work is done continuously in a similar manner, and the filling work of 8t of the toner to the containers is completed in about 120 hours, and 14,500 containers each filled up with the toner are produced.

The 120-hour filling work is performed without interrupting the supply of the toner from the powder feed hopper to the powder fluidization hopper, and overflowing from the powder fluidization hopper does not arise. The filling operation to produce continuously the containers filled up with the toner can be carried out without the intermission.

At the timing the powder feed hopper is not yet at the empty state, the toner is supplied to the powder feed hopper 20 times at the rate of 400 kg/lot to amount 8t of the toner. In this way, it is confirmed that the continuation powder filling method of the invention which is performed as described above has the following effects.

The filling speed is the time needed to complete the filling work after one container is set in the filling device, and the setting time of one container is not included.

(1) Filling Speed: 10 sec (550 g/one Container)

The filling density of the toner in the powder filling container: 0.38 g/cc (3) State of the External Additive of the Toner after Filling:

The SEM photograph showing the separation state and the burial state of the external additive is observed by comparison with the state before filling, and it is confirmed that the external additive adheres to the toner particle surface normally.

(4) Image Obtained with the Toner after Filling:

As a result of carrying out continuation printing of the image on 20000 sheets with Ricoh color printer, Ipsio Color 8000 using the toner after filling, all the sheets are printed without development of a poor image, such as greasing.

COMPARATIVE EXAMPLE

The toner supply state from the powder feed hopper to the powder fluidization hopper at the time of carrying out without forming a fluidization portion and an immobilizing portion in the toner layer surface in the powder fluidization hopper like the continuation powder filling method of the invention is observed.

1) When the whole toner layer in the powder fluidization hopper is fluidized, the supply of the toner from the powder feed hopper become superfluous and the toner overflows from the powder fluidization hopper. In order to stop the overflow, the powder fluidization hopper top opening is covered with the flexible cover made of nylon. However, it is confirmed that the toner dispersed from the gap and continuous production of a toner filling container is impossible.
2) When the whole toner layer in the powder fluidization hopper is made into an immobilizing portion, the delivery of the toner from the powder fluidization hopper to the measuring tank stops at the time of production of nine toner filling containers. And a hole (rat hole) is formed in the toner layer in the powder feed hopper, and the state of toner bridging occurs. It-is confirmed that continuous production of a toner filling container is impossible.

INDUSTRIAL APPLICABILITY

As mentioned above, according to the powder filling device and method of this invention, it is possible to fill up a small powder filling container with a given amount of a powder, especially a toner for electrostatic latent image development whose average particle diameter is on the order of microns, quickly and safely, not giving stress to the toner for electrostatic latent image development, without spoiling many of the physical properties and combination characteristics.

According to the powder filling device and method of this invention, the powder filling container can be filled up safely without making the working environment and the worker dirty. And when the subdivision for the fractionation storage from the large-sized container is temporarily stored in the small powder container or delivered in the manufacturing process of powder and also in the case of filling on demand to the small toner container at the location of an end user, the powder filling method and device of this invention may be used suitably.

The invention claimed is:

1. A powder filling device comprising:

a measuring tank having a powder discharge port;

a filling amount control unit disposed near the powder discharge port; and an auxiliary container having an opening disposed on an underside of the powder discharge port of the measuring tank which faces downward, wherein a powder externally delivered into the measuring tank is discharged from the powder discharge port into a powder filling container disposed on an underside of the auxiliary container while a filling amount of the powder is controlled by the filling amount control unit, and the powder is temporarily dropped to the auxiliary container, and further dropped to the powder filling container so that the powder filling container is filled up with the powder, wherein the filling amount control unit includes a filter material which passes a gas and does not pass the powder, the powder being drawn to the filter material via a gas suction unit communicating with the filling amount control unit, so that the filling amount of the powder is controlled according to a degree of suction of the powder by the gas suction unit, wherein the filter material is fixed to close a through hole formed in a tubular body part of the auxiliary container, and wherein a wall, which does not have a gas leakage, is disposed around an outside of the filter material so that a space part is formed.

2. The powder filling device according to claim 1 wherein the auxiliary container is a conical funnel shape, and is arranged so that the tubular body part of the auxiliary container having an outlet is inserted into an opening of the powder filling container.

3. The powder filling device according to claim 2 wherein an angle of a conical top part of the auxiliary container is in a range of 50 to 70 degrees.

4. The powder filling device according to claim 1 wherein the powder filling device further comprises a rising/falling unit provided for moving up and down the auxiliary container.

5. The powder filling device according to claim 1 wherein the filling amount control unit is provided with at least three filling amount control functions of free powder discharging, powder discharge stopping, and partial powder discharging.

6. The powder filling device according to claim 1 wherein the measuring tank is formed with a cylinder body which extends from a position where the filling amount control unit is disposed to a position of the powder discharge port.

7. The powder filling device according to claim 1 wherein the filling amount control unit includes an elastic body ring fixed to the powder discharge port of the measuring tank, and a discharge control unit which controls discharging of the powder from the powder discharge port, wherein the discharge control unit includes a discharge amount control member which is mounted on a discharge control lever which is moved up and down within the measuring tank, and wherein the discharge amount control member includes a conical-shape member which opens and closes the powder discharge port by separation of the conical-shape member from the powder discharge port and insertion of the conical-shape member to the powder discharge port.

8. The powder filling device according to claim 7 wherein a degree of opening/closing of the powder discharge port is adjusted by a degree of insertion of the conical-shape member to an opening of the elastic body ring which depends on a degree of an up/down movement of the discharge control lever within the measuring tank.

9. The powder filling device according to claim 1 wherein the auxiliary container is a funnel-shaped auxiliary container including a gas permutation unit.

10. The powder filling device according to claim 1 wherein the filter material is formed in a twill weave.

11. The powder filling device according to claim 1 further comprising a powder fluidization hopper that is connected with the measuring tank, wherein, after the powder in the powder fluidization hopper is delivered to the measuring tank temporarily, the powder in the measuring tank is delivered to the powder filling container.

12. The powder filling device according to claim 11 wherein a powder outlet of the powder fluidization hopper and a powder inlet of the measuring tank communicate with each other through a connecting tube.

13. The powder filling device according to claim 11 wherein the powder fluidization hopper comprises an inclined inside wall portion, and the powder inside the powder fluidization hopper is sent to a powder outlet by the inclined inside wall portion.

14. The powder filling device according to claim 11 wherein the powder fluidization hopper comprises a powder fluidization unit, and the powder in the powder fluidization hopper is fluidized with the gas sent from the powder fluidization unit, and the fluidized powder is sent to the measuring tank.

15. The powder filling device according to claim 14 wherein the powder fluidization unit is provided with a gas introducing pipe attached thereto, and the gas introducing pipe introduces a pressurized gas to a porous body which has fine holes for spouting the gas, and the fine holes communicate with each other inside the porous body.

16. The powder filling device according to claim 14 wherein a plurality of powder fluidization units are provided, and each powder fluidization unit is provided with a gas introducing pipe attached thereto.

17. The powder filling device according to claim 13 wherein the powder fluidization unit is disposed at the inclined inside wall portion.

18. The powder filling device according to claim 12 wherein the powder fluidization unit is provided with a gas introducing pipe attached thereto, and wherein the connecting tube has a downward inclination such that the powder fluidized with the gas sent from the gas introducing pipe is delivered from the powder fluidization hopper to the measuring tank through the connecting tube.

19. The powder filling device according to claim 11 wherein at least one of the powder fluidization hopper and the measuring tank is provided with a pressure control unit which controls an internal pressure of the at least one of the powder fluidization hopper and the measuring tank.

20. The powder filling device according to claim 1 wherein a filling powder weight managing unit is provided for managing the filling amount of the powder to the powder filling container.

21. The powder filling device according to claim 20 wherein the filling powder weight managing unit comprises a computation processing unit which computes a filled-up powder weight based on an empty weight of the powder filling container on a load cell and a gross weight of the powder filling container which is filled up with the powder.

22. The powder filling device according to claim 11 further comprising a powder feed hopper that supplies the powder to the powder fluidization hopper, wherein a leading edge of a cylindrical part of the powder feed hopper where the powder is supplied is arranged so that the leading edge is buried in a surface portion of a powder layer of the powder fluidization hopper.

23. A powder filling method which fills up a powder filling container with a powder using a powder filling device comprising a measuring tank having a powder discharge port and a filling amount control unit disposed near the powder discharge port, and an auxiliary container having an opening disposed on an underside of the powder discharge port of the measuring tank which faces downward, the powder filling method comprising:

providing the measuring tank;

providing the auxiliary container;

providing the filling amount control unit;

disposing the powder filling container on an underside of the auxiliary container;

discharging the powder, which is externally delivered into the measuring tank, from the powder discharge port into the powder filling container while a filling amount of the powder is controlled by the filling amount control unit;

temporarily dropping the powder in the auxiliary container so that a gas existing between particles of the powder within the auxiliary container is freely discharged;

further dropping the powder in the powder filling container so that the powder filling container is filled up with the powder;

passing a gas and not passing the powder via a filter material of the filling amount control unit, the powder being drawn to the filter material via a gas suction unit communicating with the filling amount control unit, so that a filling amount of the powder is controlled according to a degree of suction of the powder by the gas suction unit; and fixing the filter material of the filling amount control unit to close a through hole formed in a tubular body part of the auxiliary container, and providing a wall which does not have a gas leakage around an outside of the filter material so that a space part is formed.

24. The powder filling method according to claim 23 wherein the filling amount control unit is provided with at least three filling amount control functions of free powder discharging, powder discharge stopping, and partial powder discharging.

25. The powder filling method according to claim 23 wherein the powder filling device comprises a powder fluidization hopper which is connected with the measuring tank and has a powder fluidization unit, and the powder in the powder fluidization hopper is fluidized, and the fluidized powder is sent to the measuring tank.

26. The powder filling method according to claim 25 wherein an internal pressure of at least one of the powder fluidization hopper and the measuring tank control is controlled during a filling operation of the powder, before the filling operation, and/or after the filling operation.

27. The powder filling method according to claim 23 wherein the powder filling device comprises a filling powder weight managing unit which has a computation processing unit, and a filled-up powder weight is computed based on an empty weight of the powder filling container and a gross weight of the powder filling container which is filled up with the powder.

28. The powder filling method according to claim 27 wherein an initial filling weight of the powder is inputted and the inputted initial filling weight is changed by using the computation processing unit.

29. The powder filling method according to claim 23 wherein a powder in a powder fluidization hopper is always made in a fluidized state, and wherein a weight of the powder filling container itself is measured, so that a process which disposes the powder filling container on the measuring tank and fills up the powder filling container with the powder of a given amount is repeatedly performed to produce a plurality of powder filling containers each filled up with the powder.

30. The powder filling method according to claim 23 wherein a weight of the whole powder filling container is measured before and after the powder filling, and a filling amount of the powder is regulated by using the filling amount control unit.

31. A powder filling device comprising:

a measuring tank having a powder discharge port and a filling amount control unit disposed near the powder discharge port; and an auxiliary container having a gas permutation unit disposed on an underside of the powder discharge port of the measuring tank which faces downward, wherein a powder externally delivered into the measuring tank is discharged from the powder discharge port into a powder filling container disposed on an underside of the auxiliary container while a filling amount of the powder is controlled by the filling amount control unit, and the powder is temporarily dropped to the auxiliary container, and further dropped to the powder filling container so that the powder filling container is filled up with the powder, wherein the filling amount control unit includes a filter material which passes a gas and does not pass the powder, the powder being drawn to the filter material via a gas suction unit communicating with the filling amount control unit, so that the filling amount of the powder is controlled according to a degree of suction of the powder by the gas suction unit, wherein the filter material is fixed to close a through hole formed in a tubular body part of the auxiliary container, and wherein a wall, which does not have a gas leakage, is disposed around an outside of the filter material so that a space part is formed.

32. The powder filling device according to claim 31 wherein the auxiliary container is of a conical funnel shape, a leading edge of the conical funnel-shaped auxiliary container being provided with a cylindrical body having a powder outlet and being inserted into an opening of the powder filling container, and a cone bottom of the conical funnel-shaped auxiliary container is provided with an opening part in which the powder discharge port of the measuring tank is inserted.

33. The powder filling device according to claim 32 wherein the gas permutation unit is provided in the conical funnel-shaped auxiliary container, and the gas permutation unit comprises a gas ventilating pipe which is disposed and fixed to extend from a position near the powder outlet of the auxiliary container to an upper part of the auxiliary container.

34. The powder filling device according to claim 33 wherein the gas ventilating pipe is formed integrally with the auxiliary container.

35. The powder filling device according to claim 32 wherein an angle of a conical top part of the auxiliary container is in a range of 50 to 70 degrees.

36. The powder filling device according to claim 31 wherein the powder filling device further comprises a rising/falling unit provided for moving up and down the auxiliary container.

37. The powder filling device according to claim 31 wherein the filling amount control unit is provided with at least three filling functions of free powder discharging, powder discharge stopping, and partial powder discharging.

38. The powder filling device according to claim 31 wherein the measuring tank is formed with the tubular body which extends from a position where the filling amount control unit is disposed to a position of the powder discharge port.

39. The powder filling device according to claim 31 wherein the filling amount control unit includes an elastic body ring fixed to the powder discharge port of the measuring tank, and a discharge control unit which controls discharging of the powder from the powder discharge port, wherein the discharge control unit includes a discharge amount control member which is mounted on a discharge control lever which is moved up and down within the measuring tank, and wherein the discharge amount control member includes a conical-shape member which opens and closes the powder discharge port by separation of the conical-shape member from the powder discharge port and insertion of the conical-shape member to the powder discharge port.

40. The powder filling device according to claim 39 wherein a degree of opening/closing of the powder discharge port is adjusted by a degree of insertion of the conical-shape member to an opening of the elastic body ring which depends on a degree of an up/down movement of the discharge control lever within the measuring tank.

41. The powder filling device according to claim 31 wherein the filter material is formed in a twill weave.

42. The powder filling device according to claim 31 further comprising a powder fluidization hopper connected with the measuring tank, wherein, after the powder in the powder fluidization hopper is delivered to the measuring tank temporarily, the powder in the measuring tank is delivered to the powder filling container.

43. The powder filling device according to claim 42 wherein the powder fluidization hopper comprises an inclined inside wall portion, and the powder inside the powder fluidization hopper is sent to a powder outlet by the inclined inside wall portion.

44. The powder filling device according to claim 42 wherein the powder fluidization hopper comprises a powder fluidization unit, and the powder in the powder fluidization hopper is fluidized with a gas sent from the powder fluidization unit, and the fluidized powder is sent to the measuring tank.

45. The powder filling device according to claim 44 wherein the powder fluidization unit is provided with a gas introducing pipe attached thereto, and the gas introducing pipe introduces a pressurized gas to a porous body which has fine holes for spouting a gas, and the fine holes communicate with each other inside the porous body.

46. The powder filling device according to claim 43 wherein the powder fluidization unit is disposed at the inclined inside wall portion.

47. The powder filling device according to claim 42 wherein a powder outlet of the powder fluidization hopper and a powder inlet of the measuring tank communicate with each other through a connecting tube, wherein the powder fluidization unit is provided with a gas introducing pipe attached thereto, and wherein the connecting tube has a downward inclination such that the powder fluidized with the gas sent from the gas introducing pipe is delivered from the powder fluidization hopper to the measuring tank through the connecting tube.

48. The powder filling device according to claim 31 wherein a filling powder weight managing unit is provided for managing the filling amount of the powder to the powder filling container.

49. The powder filling device according to claim 48 wherein the filling powder weight managing unit comprises a computation processing unit which computes a filled-up powder weight based on an empty weight of the powder filling container on a load cell and a gross weight of the powder filling container which is filled up with the powder.

50. The powder filling device according to claim 42 further comprising a powder feed hopper that supplies the powder to the powder fluidization hopper, wherein a leading edge of a cylindrical part of the powder feed hopper where the powder is supplied is arranged so that the leading edge is buried in a surface portion of a powder layer of the powder fluidization hopper.

* * * * *